US011112151B2

(12) United States Patent
Ueda et al.

(10) Patent No.: US 11,112,151 B2
(45) Date of Patent: Sep. 7, 2021

(54) HEAT SOURCE UNIT FOR REFRIGERATION APPARATUS INCLUDING A HEAT-SOURCE-SIDE HEAT EXCHANGER HAVING A HEAT EXCHANGE REGION OF VARIABLE SIZE

(71) Applicant: DAIKIN INDUSTRIES, LTD., Osaka (JP)

(72) Inventors: Hiroki Ueda, Osaka (JP); Eisaku Okubo, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 179 days.

(21) Appl. No.: 16/321,341

(22) PCT Filed: Aug. 2, 2017

(86) PCT No.: PCT/JP2017/028134
§ 371 (c)(1),
(2) Date: Jan. 28, 2019

(87) PCT Pub. No.: WO2018/025934
PCT Pub. Date: Feb. 8, 2018

(65) Prior Publication Data

US 2019/0170416 A1 Jun. 6, 2019

(30) Foreign Application Priority Data

Aug. 3, 2016 (JP) ..... JP2016-153006

(51) Int. Cl.
*F25B 49/02* (2006.01)
*F25B 39/02* (2006.01)
(Continued)

(52) U.S. Cl.
CPC ..... *F25B 39/028* (2013.01); *F24H 4/02* (2013.01); *F25B 5/02* (2013.01); *F25B 6/02* (2013.01);
(Continued)

(58) Field of Classification Search
CPC .. F25B 5/02; F25B 6/02; F25B 39/028; F25B 2600/2511
See application file for complete search history.

(56) References Cited

U.S. PATENT DOCUMENTS 6,138,919 A * 10/2000 Cooper ..... F25B 5/02 237/2 B
2015/0198360 A1 7/2015 Wakamoto et al.
(Continued)

FOREIGN PATENT DOCUMENTS

EP 2 927 623 A1 10/2015
JP 7-12417 A 1/1995
(Continued)

OTHER PUBLICATIONS

Extended European Search Report dated Jan. 17, 2020, for counterpart European Application No. 17837036.7.
(Continued)

*Primary Examiner* — Jonathan Bradford
(74) *Attorney, Agent, or Firm* — Birch, Stewart, Kolasch & Birch, LLP

(57) ABSTRACT

In an air conditioner which is a refrigeration apparatus, a heat source unit has a heat-source-side heat exchanger in which a refrigerant exchanges heat with heat source water. The heat-source-side heat exchanger includes a plurality of heat exchange sections, and has a heat exchange region whose size can be adjusted through changing the number of heat exchange sections into which the refrigerant flows. The heat source unit has a controller which can adjust the size of the heat exchange region of the heat-source-side heat exchanger based on a differential pressure index value. This can broaden the temperature range of the heat source water within which the heat source unit of the refrigeration apparatus is operable.

8 Claims, 13 Drawing Sheets

(51) Int. Cl.

| | |
|---|---|
| ***F25B 13/00*** | (2006.01) |
| ***F25B 5/02*** | (2006.01) |
| ***F25B 27/00*** | (2006.01) |
| ***F25B 6/02*** | (2006.01) |
| ***F24H 4/02*** | (2006.01) |

(52) U.S. Cl.
CPC ..... *F25B 13/00* (2013.01); *F25B 27/00* (2013.01); *F25B 49/02* (2013.01); *F25B 2339/047* (2013.01); *F25B 2600/2511* (2013.01); *F25B 2600/2519* (2013.01); *F25B 2700/1931* (2013.01); *F25B 2700/1933* (2013.01); *F25B 2700/21161* (2013.01); *F25B 2700/21171* (2013.01)

(56) References Cited

U.S. PATENT DOCUMENTS

| | | | | |
|---|---|---|---|---|
| 2015/0377508 | A1* | 12/2015 | Imada ..... | F24F 3/044<br>62/159 |
| 2017/0130996 | A1* | 5/2017 | Hatanaka ..... | F24F 11/89 |

FOREIGN PATENT DOCUMENTS

| | | | |
|---|---|---|---|
| JP | 8-210719 | A | 8/1996 |
| JP | 2016-8788 | A | 1/2016 |
| WO | 2015/162679 | A1 | 10/2015 |

OTHER PUBLICATIONS

International Search Report issued in PCT/JP2017/028134 (PCT/ISA/210), dated Oct. 17, 2017.

* cited by examiner

COOLING OPERATION

HEATING OPERATION

HEAT SOURCE UNIT FOR REFRIGERATION APPARATUS INCLUDING A HEAT-SOURCE-SIDE HEAT EXCHANGER HAVING A HEAT EXCHANGE REGION OF VARIABLE SIZE

TECHNICAL FIELD

The present invention relates to a heat source unit of a refrigeration apparatus which performs a refrigeration cycle.

BACKGROUND ART

For example, Patent Documents 1 and 2 disclose air conditioners comprised of a refrigeration apparatus which performs a refrigeration cycle. The air conditioners disclosed by Patent Documents 1 and 2 include a single heat source unit (outdoor unit) and a plurality of indoor units. In the air conditioners of Patent Documents 1 and 2, the heat source unit houses components such as a compressor and a heat-source-side heat exchanger, and the heat-source-side heat exchanger allows a refrigerant in a refrigerant circuit to exchange heat with heat source water. The heat-source-side heat exchanger functions as a condenser in a cooling operation (while cooling the indoor space), and as an evaporator in a heating operation (while heating the indoor space).

CITATION LIST

Patent Document

[Patent Document 1] Japanese Unexamined Patent Publication No. H07-012417

[Patent Document 2] Japanese Unexamined Patent Publication No. H08-210719

SUMMARY OF THE INVENTION

Technical Problem

Regarding a refrigeration apparatus including a heat-source-side heat exchanger in which a refrigerant and heat source water exchange heat, there has been a problem of a relatively narrow temperature range of the heat source water within which the refrigeration apparatus is operable. This problem will be described below with reference to FIGS. 13A and 13B.

In FIGS. 13A and 13B, "load factor" designates a value, expressed as a percentage, obtained by dividing a capability required for the refrigeration apparatus (i.e., a required value of a cooling or heating capability) by a rated capability of the refrigeration apparatus (i.e., a rated cooling or heating capability). The maximum capability of the refrigeration apparatus varies depending on temperature Tw_of the heat source water.

First, as shown in FIG. 13A, during the cooling operation, the refrigeration apparatus is operable if the temperature Tw_of the heat source water is in a range of T0_*c* or more to T2_*c* or less (T0_*c*≤Tw≤T2_*c*) irrespective of the value of the load factor.

However, in a region A where both of the temperature Tw_of the heat source water and the load factor are relatively low, a difference between high pressure (condensing pressure of the refrigerant) and low pressure (evaporating pressure of the refrigerant) of the refrigeration cycle is too small, and thus, the refrigeration apparatus cannot operate. Specifically, in the region A, the capability of the heat-source-side heat exchanger which functions as a condenser is excessive, thereby lowering the high pressure of the refrigeration cycle. On the other hand, the evaporation temperature of the refrigerant is kept approximately constant and the low pressure of the refrigeration cycle hardly changes. As a result, the difference between the high pressure and low pressure of the refrigeration cycle becomes too small.

Next, as shown in FIG. 13B, during the heating operation, the refrigeration apparatus is operable if the temperature Tw_of the heat source water is in a range of T3 or more to T4 or less (T3≤Tw≤T4) irrespective of the value of the load factor.

However, in a region B where the temperature Tw_of the heat source water is relatively low and the load factor is relatively high, the low pressure of the refrigeration cycle is too low, and thus, the refrigeration apparatus cannot operate. Specifically, in the region B, the capability of the heat-source-side heat exchanger which functions as an evaporator is insufficient, and the load factor is high, as a result of which the rotational speed of the compressor is set high so as to ensure the circulation of the refrigerant. This makes the low pressure of the refrigeration cycle too low.

In a region C where the temperature Tw_of the heat source water is relatively high and the load factor are relatively low, the difference between the high pressure and low pressure of the refrigeration cycle is too small, and thus, the refrigeration apparatus cannot operate. Specifically, in the region C, the capability of the heat-source-side heat exchanger which functions as an evaporator is excessive, thereby raising the low pressure of the refrigeration cycle. On the other hand, the condensing temperature of the refrigerant is kept approximately constant and the high pressure of the refrigeration cycle hardly changes. As a result, the difference between the high pressure and low pressure of the refrigeration cycle becomes too small.

As the heat source water used for cooling which is supplied to the heat-source-side heat exchanger serving as a condenser, it has been general to use heat source water cooled by a cooling tower. However, nowadays, another type of heat source water cooled through heat exchange with soil in an underground heat exchanger buried in the ground is sometimes used as the heat source water for cooling. In such a case, the heat source water for cooling is generally lower in temperature than the generally used heat source water cooled by the cooling tower. For this reason, the refrigeration apparatus is required to be able to perform the cooling operation at any load factor, even if the heat source water which is lower in temperature than the generally used heat source water (in particular, lower than the temperature T0_*c* in FIG. 13A) is used.

Further, as the heat source water used for heating which is supplied to the heat-source-side heat exchanger serving as an evaporator, heat source water heated by a boiler has been generally used. However, nowadays, another type of heat source water heated through heat exchange with soil in an underground heat exchanger buried in the ground is sometimes used as the heat source water for heating. In such a case, the heat source water for heating is generally lower in temperature than the generally used heat source water heated by the boiler. For this reason, the refrigeration apparatus is required to be able to perform the heating operation at any load factor, even if the heat source water which is lower in temperature than the generally used heat source water (in particular, lower than the temperature T3 in FIG. 13B) is used.

The temperature of hot water heated by a common boiler is too high for the heat exchange with the refrigerant in an evaporator in the refrigeration cycle. Thus, according to existing techniques, a portion of the heat source water heated with the boiler and the rest of the heat source water that has bypassed the boiler are mixed together and supplied to the evaporator of the refrigeration apparatus. Alternatively, hot water obtained through heating with the boiler is allowed to exchange heat with the heat source water, thereby feeding the heat source water indirectly heated in this manner to the evaporator of the refrigeration apparatus. However, if the temperature of the heat source water to be fed to the refrigeration apparatus is lowered by such techniques, the efficiency of the boiler may be lowered, or the circulation of the heat source water may increase, which requires more power for the conveyance of the heat source water. Therefore, the refrigeration apparatus is required to be able to perform the heating operation at any load factor, even if the heat source water which is higher in temperature than the generally used heat source water (in particular, higher than the temperature T4 in FIG. 13B) is used.

As can be seen, regarding a heat source unit of a refrigeration apparatus including a heat-source-side heat exchanger in which a refrigerant and heat source water exchange heat, there is growing demand for broadening the temperature range of the heat source water within which the refrigeration apparatus is operable.

In view of the foregoing background, it is therefore an object of the present invention to broaden, in a refrigeration apparatus including a heat-source-side heat exchanger in which a refrigerant exchanges heat with the heat source water, the temperature range of the heat source water within which a heat source unit is operable.

Solution to the Problem

A first aspect of the present disclosure is directed to a heat source unit forming, together with a utilization-side unit (12), a refrigeration apparatus (10) including a refrigerant circuit (15) performing a refrigeration cycle, the heat source unit housing at least a compressor (21) and a heat-source-side heat exchanger (40), each of which is provided for the refrigerant circuit (15). The heat-source-side heat exchanger (40) is connected to a heat source water circuit (100) in which heat source water circulates so that a refrigerant circulating in the refrigerant circuit (15) exchanges heat with the heat source water, the heat-source-side heat exchanger (40) having a heat exchange region, of a variable size, in which the refrigerant flows and exchanges heat with the heat source water, and the heat source unit comprises a controller (70) which adjusts the size of the heat exchange region of the heat-source-side heat exchanger (40) based on a differential pressure index value indicating a difference between high pressure and low pressure of the refrigeration cycle performed by the refrigerant circuit (15).

In the first aspect, the controller (70) adjusts the size of the heat exchange region of the heat-source-side heat exchanger (40) in accordance with the differential pressure index value. If the size of the heat exchange region of the heat-source-side heat exchanger (40) is changed, the capability of the heat-source-side heat exchanger (40), i.e., a quantity of heat exchanged between the refrigerant and the heat source water, varies. Therefore, if the controller (70) adjusts the size of the heat exchange region of the heat-source-side heat exchanger (40), the capability of the heat-source-side heat exchanger (40) can be suitably controlled.

A second aspect of the present disclosure is an embodiment of the second aspect. In the second aspect, the controller (70) adjusts the size of the heat exchange region of the heat-source-side heat exchanger (40) so that the differential pressure index value becomes equal to or more than a predetermined reference index value.

In the second aspect, the controller (70) adjusts the size of the heat exchange region of the heat-source-side heat exchanger (40) so that the differential pressure index value is equal to or more than the predetermined reference index value. If the differential pressure index value is equal to or more than the reference index value, the difference between the high pressure and low pressure of the refrigeration cycle performed in the refrigerant circuit (15) can be kept equal to or more than a certain level.

A third aspect of the present disclosure is an embodiment of the second aspect. In the third aspect, the controller (70) reduces the size of the heat exchange region of the heat-source-side heat exchanger (40) if the differential pressure index value falls below the reference index value.

In the third aspect, the controller (70) reduces the size of the heat exchange region of the heat-source-side heat exchanger (40) if the differential pressure index value falls below the reference index value. If the size of the heat exchange region of the heat-source-side heat exchanger (40) is reduced, the capability of the heat-source-side heat exchanger (40) decreases. Thus, the high pressure of the refrigeration cycle increases when the heat-source-side heat exchanger (40) functions as a condenser, and the low pressure of the refrigeration cycle decreases when the heat-source-side heat exchanger (40) functions as an evaporator. As a result, the difference between the high pressure and low pressure of the refrigeration cycle performed in the refrigerant circuit (15) increases.

A fourth aspect of the present disclosure is an embodiment of the second or third aspect. In the fourth aspect, the controller (70) estimates the differential pressure index value on the assumption that the size of the heat exchange region of the heat-source-side heat exchanger (40) which is smaller than a maximum size has been increased, and increases the size of the heat exchange region of the heat-source-side heat exchanger (40) if the estimated differential pressure index value exceeds the reference index value.

In the fourth aspect, if the size of the heat exchange region of the heat-source-side heat exchanger (40) has been reduced to be smaller than the maximum value, the controller (70) estimates the differential pressure index value on the assumption that the size of the heat exchange region has been increased. Then, the controller (70) increases the size of the heat exchange region of the heat-source-side heat exchanger (40) if the estimated differential pressure index value exceeds the reference index value.

If the size of the heat exchange region of the heat-source-side heat exchanger (40) increases, the capability of the heat-source-side heat exchanger (40) increases. Thus, the high pressure of the refrigeration cycle decreases when the heat-source-side heat exchanger (40) functions as a condenser, and the low pressure of the refrigeration cycle increases when the heat-source-side heat exchanger (40) functions as an evaporator. As a result, the difference between the high pressure and low pressure of the refrigeration cycle performed in the refrigerant circuit (15) decreases.

Thus, if the size of the heat exchange region of the heat-source-side heat exchanger (40), which is smaller than the maximum size, is increased immediately when the differential pressure index value has exceeded the reference index value, the differential pressure index value may fall below the reference index value, and the controller (70) may possibly reduce the size of the heat exchange region of the heat-source-side heat exchanger (40) again. As a result, the size of the heat exchange region of the heat-source-side heat exchanger (40) may repeat the increase and decrease, which may lead to unstable refrigeration cycle performed in the refrigerant circuit (15).

The controller (70) according to the fourth aspect increases the size of the heat exchange region of the heat-source-side heat exchanger (40) if the differential pressure index value, estimated on the assumption that the size of the heat exchange region has been increased, has exceeded the reference index value. Therefore, even if the size of the heat exchange region of the heat-source-side heat exchanger (40) is increased and the difference between the high pressure and low pressure of the refrigeration cycle performed in the refrigerant circuit (15) decreases, the differential pressure index value is less likely to fall below the reference index value.

A fifth aspect of the present disclosure is an embodiment of any one of the first to third aspects. In the fifth aspect, the heat source unit performs a cooling action in which the heat-source-side heat exchanger (40) functions as a condenser to cool a target in the utilization-side unit (12), and the controller (70) determines, during the cooling action, a difference between an entering water temperature and an evaporation temperature or target evaporation temperature of the refrigerant in the utilization-side unit (12) to be the differential pressure index value, the entering water temperature being a temperature of the heat source water supplied to the heat-source-side heat exchanger (40), and the target evaporation temperature being a target value of the evaporation temperature.

The heat source unit (11) according to the fifth aspect can perform a cooling action in which the heat-source-side heat exchanger (40) functions as a condenser. The condensing temperature of the refrigerant in the heat-source-side heat exchanger (40) is generally higher than the entering water temperature by a certain value. Further, the condensing temperature of the refrigerant in the heat-source-side heat exchanger (40) correlates with the high pressure of the refrigeration cycle, and the evaporation temperature of the refrigerant in the utilization-side unit (12) correlates with the low pressure of the refrigeration cycle. Thus, the difference (Tw_i−Te) or (Tw_i−Te_t) between the entering water temperature Tw_i and the evaporation temperature Te of the refrigerant in the utilization-side unit (12) or the target evaporation temperature Te_t, which is a target value of the evaporation temperature, increases with the increase, or decreases with the decrease, in the difference between the high pressure and low pressure of the refrigeration cycle. Thus, the value (Tw_i−Te) or (Tw_i−Te_t) can be a differential pressure index value indicating the difference between the high pressure and low pressure of the refrigeration cycle performed in the refrigerant circuit (15).

A sixth aspect of the present disclosure is an embodiment of any one of the first to third aspects. In the sixth aspect, the heat source unit performs a heating action in which the heat-source-side heat exchanger (40) functions as an evaporator to heat a target in the utilization-side unit (12), and the controller (70) determines, during the heating action, a difference between a condensing temperature or target condensing temperature of the refrigerant in the utilization-side unit (12) and an entering water temperature to be the differential pressure index value, the target condensing temperature being a target value of the condensing temperature, and the entering water temperature being a temperature of the heat source water supplied to the heat-source-side heat exchanger (40).

The heat source unit (11) according to the sixth aspect can perform a heating action in which the heat-source-side heat exchanger (40) functions as an evaporator. The evaporation temperature of the refrigerant in the heat-source-side heat exchanger (40) is generally lower than the entering water temperature by a certain value. Further, the condensing temperature of the refrigerant in the utilization-side unit (12) correlates with the high pressure of the refrigeration cycle, and the evaporation temperature of the refrigerant in the heat-source-side heat exchanger (40) correlates with the low pressure of the refrigeration cycle. Thus, the difference (Tc−Tw_i) or (Tc−Tw_i) between the condensing temperature Tc of the refrigerant in the utilization-side unit (12) or the target condensing temperature Tc_t, which is a target value of the condensing temperature, increases with the increase, or decreases with the decrease in the difference between the high pressure and low pressure of the refrigeration cycle. Thus, the value (Tc−Tw_i) or (Tc−Tw_i) can be a differential pressure index value indicating the difference between the high pressure and low pressure of the refrigeration cycle performed in the refrigerant circuit (15).

A seventh aspect of the present disclosure is an embodiment of any one of the first to fourth aspects. In the seventh aspect, the heat source unit performs a cooling action in which the heat-source-side heat exchanger (40) functions as a condenser to cool a target in the utilization-side unit (12), and the controller (70) determines, during the cooling action, a difference between a condensing temperature of the refrigerant in the heat-source-side heat exchanger (40) and an evaporation temperature or target evaporation temperature of the refrigerant in the utilization-side unit (12) to be the differential pressure index value, the target evaporation temperature being a target value of the evaporation temperature.

The heat source unit (11) according to the seventh aspect can perform a cooling action in which the heat-source-side heat exchanger (40) functions as a condenser. The condensing temperature of the refrigerant in the heat-source-side heat exchanger (40) correlates with the high pressure of the refrigeration cycle, and the evaporation temperature of the refrigerant in the utilization-side unit (12) correlates with the low pressure of the refrigeration cycle. Thus, the difference (Tc_hs−Te) or (Tc_hs−Te_t) between the condensing temperature Tc_hs of the refrigerant in the heat-source-side heat exchanger (40) and the evaporation temperature Te of the refrigerant in the utilization-side unit (12) or the target evaporation temperature Te_t, which is a target value of the evaporation temperature, increases with the increase, or decreases with the decrease, in the difference between the high pressure and low pressure of the refrigeration cycle. Thus, the value (Tc_hs−Te) or (Tc_hs−Te_t) can be a differential pressure index value indicating the difference between the high pressure and low pressure of the refrigeration cycle performed in the refrigerant circuit (15).

An eighth aspect of the present disclosure is an embodiment of any one of the first to fourth aspects. In the eighth aspect, the heat source unit performs a heating action in which the heat-source-side heat exchanger (40) functions as an evaporator to heat a target in the utilization-side unit (12), and the controller (70) determines, during the heating action, a difference between a condensing temperature or target condensing temperature of the refrigerant in the utilization-side unit (12) and an evaporation temperature of the refrigerant in the heat-source-side heat exchanger (40) to be the differential pressure index value, the target condensing temperature being a target value of the condensing temperature.

The heat source unit (11) according to the eighth aspect can perform a heating action in which the heat-source-side heat exchanger (40) functions as an evaporator. The condensing temperature of the refrigerant in the utilization-side unit (12) correlates with the high pressure of the refrigeration cycle, and the evaporation temperature of the refrigerant in the heat-source-side heat exchanger (40) correlates with the low pressure of the refrigeration cycle. Thus, the difference (Tc−Te_hs) or (Tc_t−Te_hs) between the condensing temperature Tc of the refrigerant in the utilization-side unit (12) or the target condensing temperature Tc_t, which is a target value of the condensing temperature, and the evaporation temperature Te_hs of the refrigerant in the heat-source-side heat exchanger (40) increases with the increase, or decreases with the decrease, in the difference between the high pressure and low pressure of the refrigeration cycle. Thus, the value (Tc−Te_hs) or (Tc_t−Te_hs) can be a differential pressure index value indicating the difference between the high pressure and low pressure of the refrigeration cycle performed in the refrigerant circuit (15).

A ninth aspect of the present disclosure is an embodiment of any one of the first to fourth aspects. In the ninth aspect, the heat source unit performs a cooling action in which the heat-source-side heat exchanger (40) functions as a condenser to cool a target in the utilization-side unit (12), and the controller (70) determines, during the cooling action, a difference between an exit water temperature and an evaporation temperature or target evaporation temperature of the refrigerant in the utilization-side unit (12) to be the differential pressure index value, the exit water temperature being a temperature of the heat source water flowing out of the heat-source-side heat exchanger (40), and the target evaporation temperature being a target value of the evaporation temperature.

The heat source unit (11) according to the ninth aspect can perform a cooling action in which the heat-source-side heat exchanger (40) functions as a condenser. The condensing temperature of the refrigerant in the heat-source-side heat exchanger (40) is generally higher than the exit water temperature by a certain value. Further, the condensing temperature of the refrigerant in the heat-source-side heat exchanger (40) correlates with the high pressure of the refrigeration cycle, and the evaporation temperature of the refrigerant in the utilization-side unit (12) correlates with the low pressure of the refrigeration cycle. Thus, the difference (Tw_o−Te) or (Tw_o−Te_t) between the exit water temperature Tw_o and the evaporation temperature Te of the refrigerant in the utilization-side unit (12) or the target evaporation temperature Te_t, which is a target value of the evaporation temperature, increases with the increase, or decreases with the decrease, in the difference between the high pressure and low pressure of the refrigeration cycle. Thus, the value (Tw_o−Te) or (Tw_o−Te_t) can be a differential pressure index value indicating the difference between the high pressure and low pressure of the refrigeration cycle performed in the refrigerant circuit (15).

A tenth aspect of the present disclosure is an embodiment of any one of the first to third aspects. In the tenth aspect, the heat source unit performs a heating action in which the heat-source-side heat exchanger (40) functions as an evaporator to heat a target in the utilization-side unit (12), and the controller (70) determines, during the heating action, a difference between a condensing temperature or target condensing temperature of the refrigerant in the utilization-side unit (12) and an exit water temperature to be the differential pressure index value, the target condensing temperature being a target value of the condensing temperature, and the exit water temperature being a temperature of the heat source water flowing out of the heat-source-side heat exchanger (40).

The heat source unit (11) according to the tenth aspect can perform a heating action in which the heat-source-side heat exchanger (40) functions as an evaporator. The evaporation temperature of the refrigerant in the heat-source-side heat exchanger (40) is generally lower than the exit water temperature by a certain value. Further, the condensing temperature of the refrigerant in the utilization-side unit (12) correlates with the high pressure of the refrigeration cycle, and the evaporation temperature of the refrigerant in the heat-source-side heat exchanger (40) correlates with the low pressure of the refrigeration cycle. Thus, the difference (Tc−Tw_o) or (Tc_t−Tw_o) between the condensing temperature Tc of the refrigerant in the utilization-side unit (12) or the target condensing temperature Tc_t, which is a target value of the condensing temperature, increases with the increase, or decreases with the decrease, in the difference between the high pressure and low pressure of the refrigeration cycle. Therefore, the value (Tc−Tw_o) or (Tc_t−Tw_o) can be a differential pressure index value indicating the difference between the high pressure and low pressure of the refrigeration cycle performed in the refrigerant circuit (15).

An eleventh aspect of the present disclosure is directed to a heat source unit forming, together with a utilization-side unit (12), a refrigeration apparatus (10) including a refrigerant circuit (15) performing a refrigeration cycle, the heat source unit housing at least a compressor (21) and a heat-source-side heat exchanger (40), each of which is provided for the refrigerant circuit (15). The heat-source-side heat exchanger (40) is connected to a heat source water circuit (100) in which heat source water circulates so that a refrigerant circulating in the refrigerant circuit (15) exchanges heat with the heat source water, the heat-source-side heat exchanger (40) having a heat exchange region, of a variable size, in which the refrigerant flows and exchanges heat with the heat source water, and the heat source unit comprises a controller (70) which adjusts the size of the heat exchange region of the heat-source-side heat exchanger (40) based on an entering water temperature, which is a temperature of the heat source water supplied to the heat-source-side heat exchanger (40).

In the eleventh aspect, the controller (70) adjusts the size of the heat exchange region of the heat-source-side heat exchanger (40) in accordance with the entering water temperature (i.e., the temperature of heat source water supplied to the heat-source-side heat exchanger (40)). If the size of the heat exchange region of the heat-source-side heat exchanger (40) is changed, the capability of the heat-source-side heat exchanger (40), i.e., a quantity of heat exchanged between the refrigerant and the heat source water, varies. Therefore, if the controller (70) adjusts the size of the heat exchange region of the heat-source-side heat exchanger (40), the capability of the heat-source-side heat exchanger (40) can be controlled to a value suitable for the temperature of the heat source water supplied to the heat-source-side heat exchanger (40).

A twelfth aspect of the present disclosure is an embodiment of the eleventh aspect, In the twelfth aspect, the heat source unit performs a cooling action in which the heat-source-side heat exchanger (40) functions as a radiator to cool a target in the utilization-side unit (12), and the controller (70) reduces the size of the heat exchange region of the heat-source-side heat exchanger (40) if the entering water temperature falls below a predetermined reference temperature during the cooling action.

The heat source unit (11) according to the twelfth aspect can perform a cooling action in which the heat-source-side heat exchanger (40) functions as a radiator. The capability of the heat-source-side heat exchanger (40) which functions as a radiator increases with the decrease in the temperature of the heat source water supplied to the heat-source-side heat exchanger (40). Thus, if the entering water temperature falls below the predetermined reference temperature during the cooling action and the capability of the heat-source-side heat exchanger (40) serving as a radiator may possibly be excessive, the controller (70) reduces the size of the heat exchange region of the heat-source-side heat exchanger (40). As a result, even if the temperature of the heat source water supplied to the heat-source-side heat exchanger (40) falls below the reference temperature, the heat source unit (11) can continue the cooling action.

A thirteenth aspect of the present disclosure is an embodiment of the eleventh aspect, In the thirteenth aspect, the heat source unit performs a heating action in which the heat-source-side heat exchanger (40) functions as an evaporator to heat a target in the utilization-side unit (12), and the controller (70) reduces the size of the heat exchange region of the heat-source-side heat exchanger (40) if the entering water temperature exceeds a predetermined reference temperature during the heating action.

The heat source unit (11) according to the thirteenth aspect can perform a heating action in which the heat-source-side heat exchanger (40) functions as an evaporator. The capability of the heat-source-side heat exchanger (40) which functions as an evaporator increases with the increase in the temperature of the heat source water supplied to the heat-source-side heat exchanger (40). Thus, if the entering water temperature exceeds the predetermined reference temperature during the heating action and the capability of the heat-source-side heat exchanger (40) serving as an evaporator may possibly be excessive, the controller (70) reduces the size of the heat exchange region of the heat-source-side heat exchanger (40). As a result, even if the temperature of the heat source water supplied to the heat-source-side heat exchanger (40) exceeds the reference temperature, the heat source unit (11) can continue the heating action.

A fourteenth aspect of the present disclosure is an embodiment of the twelfth or thirteenth aspect. In the fourteenth aspect, the controller (70) adjusts the reference temperature based on a load of the refrigeration apparatus (10).

In the fourteenth aspect, the controller (70) adjusts the reference temperature in accordance with a load of the refrigeration apparatus (10), a cooling or heating capability required for the refrigeration apparatus (10). Thus, the controller (70) according to this aspect adjusts the size of the heat exchange region of the heat-source-side heat exchanger (40) in consideration of both of "the temperature of the heat source water supplied to the heat-source-side heat exchanger (40)" and "the load of the refrigeration apparatus (10)."

A fifteenth aspect of the present disclosure is an embodiment of any one of the first to fourteenth aspects. In the fifteenth aspect, the heat-source-side heat exchanger (40) includes a plurality of heat exchange sections (41*a*, 41*b*) in each of which the refrigerant exchanges heat with the heat source water, and a refrigerant valve mechanism (48, 49) for changing the number of heat exchange sections (41*a*, 41*b*) into which the refrigerant flows, the size of the heat exchange region being variable through changing the number of heat exchange sections (41*a*, 41*b*) into which the refrigerant flows, and the controller (70) operates the refrigerant valve mechanism (48, 49) to adjust the size of the heat exchange region.

In the heat-source-side heat exchanger (40) according to the fifteenth aspect, at least one of the plurality of heat exchange sections (41*a*, 41*b*) into which the refrigerant flows serves as the heat exchange region. Therefore, if the refrigerant valve mechanism (48, 49) changes the number of heat exchange sections (41*a*, 41*b*) into which the refrigerant flows, the size of the heat exchange region of the heat-source-side heat exchanger (40) varies. Thus, the controller (84) of this aspect adjusts the number of heat exchange sections (41*a*, 41*b*) into which the refrigerant flows, thereby adjusting the size of the heat exchange region of the heat-source-side heat exchanger (40).

A sixteenth aspect of the present disclosure is an embodiment of the fifteenth aspect. In the sixteenth aspect, the heat-source-side heat exchanger (40) further comprises a water valve mechanism (50) for changing the number of heat exchange sections (41*a*, 41*b*) into which the heat source water flows, and the controller (70) operates the water valve mechanism (50) so that the heat source water is blocked from flowing into the heat exchange section (41*a*, 41*b*) into which the entry of the refrigerant has been blocked by the refrigerant valve mechanism (48, 49).

The controller (70) according to the sixteenth aspect operates both of the refrigerant valve mechanism (48, 49) and the water valve mechanism (50) to adjust the size of the heat exchange region of the heat-source-side heat exchanger (40). Specifically, when blocking the refrigerant from flowing into one of the heat exchange sections (41*b*) with the refrigerant valve mechanism (48, 49), the controller (70) blocks the heat source water from flowing into the heat exchange section (41*b*) with the water valve mechanism (50).

Advantages of the Invention

According to the first aspect, the controller (70) adjusts the size of the heat exchange region of the heat-source-side heat exchanger (40) in accordance with the differential pressure index value. According to the eleventh aspect, the controller (70) adjusts the size of the heat exchange region of the heat-source-side heat exchanger (40) in accordance with the entering water temperature (i.e., the temperature of heat source water supplied to the heat-source-side heat exchanger (40)). Thus, according to the present disclosure, the capability of the heat-source-side heat exchanger (40) can be set to a value suitable for the temperature of the heat source water supplied to the heat-source-side heat exchanger (40). As a result, the refrigeration apparatus (10) continue operating at any load factor even in the temperature range of the heat source water in which the refrigeration apparatus (10) has been inoperable.

According to the second aspect, the size of the heat exchange region of the heat-source-side heat exchanger (40) is adjusted based on the differential pressure index value, as a result of which the capability of the heat-source-side heat exchanger (40) can be suitably controlled.

According to the third aspect, the controller (70) reduces the size of the heat exchange region of the heat-source-side heat exchanger (40) if the differential pressure index value falls below the reference index value. This can increase the difference between the high pressure and low pressure of the refrigeration cycle performed by the refrigerant circuit (15). As a result, the difference between the high pressure and low pressure of the refrigeration cycle performed in the refrigerant circuit (15) can be kept in a suitable range, thereby allowing the refrigeration apparatus (10) to continue operating.

According to the fourth aspect, the controller (70) increases the size of the heat exchange region of the heat-source-side heat exchanger (40) if the differential pressure index value, estimated on the assumption that the size of the heat exchange region has been increased, has exceeded the reference index value. Thus, according to this aspect, the size of the heat exchange region of the heat-source-side heat exchanger (40) can be increased if the size of the heat exchange region of the heat-source-side heat exchanger (40) is less likely to repeat the increase and decrease. This can increase the size of the heat exchange region of the heat-source-side heat exchanger (40) with the refrigeration cycle performed in the refrigerant circuit (15) kept stable.

According to the fifth to tenth aspects, the controller (70) adjusts the size of the heat exchange region of the heat exchange heat exchanger (40) using a difference between various types of temperatures as the differential pressure index value. Thus, in these aspects, the size of the heat exchange region of the heat-source-side heat exchanger (40) can be adjusted with reliability using a difference between various types of temperatures as the differential pressure index value.

According to the twelfth aspect, the controller (70) reduces the size of the heat exchange region of the heat-source-side heat exchanger (40) if the entering water temperature falls below the reference temperature during the cooling action. Thus, even if the temperature of the heat source water supplied to the heat-source-side heat exchanger (40) falls below the reference temperature, the heat source unit (11) can continue the cooling action. Thus, according to this aspect, the temperature range of the heat source water in which the refrigeration apparatus (10) can continue operating can be broadened to a low temperature side.

According to the thirteenth aspect, the controller (70) reduces the size of the heat exchange region of the heat-source-side heat exchanger (40) if the entering water temperature exceeds the reference temperature during the cooling action. Thus, even if the temperature of the heat source water supplied to the heat-source-side heat exchanger (40) exceeds the reference temperature, the heat source unit (11) can continue the heating action. Therefore, according to this aspect, the temperature range of the heat source water in which the refrigeration apparatus (10) can continue operating can be broadened to a high temperature side.

The controller (70) according to the fourteenth aspect adjusts the reference temperature in accordance with a load of the refrigeration apparatus (10). Thus, according to this aspect, the size of the heat exchange region of the heat-source-side heat exchanger (40) can be adjusted in consideration of both of "the temperature of the heat source water supplied to the heat-source-side heat exchanger (40)" and "the load of the refrigeration apparatus (10)."

According to the sixteenth aspect, not only the refrigerant, but also the heat source water, is blocked from flowing into the heat exchange section (41*b*) which does not serve as the heat exchange region. This can further reduce power required for the conveyance of the heat source water than the case where the heat source water is continuously supplied to the heat exchange section (41*b*) which does not serve as the heat exchange section.

DESCRIPTION OF EMBODIMENTS

Embodiments of the present invention will be described in detail with reference to the drawings. Note that the following embodiments and variations are merely exemplary ones in nature, and do not intend to limit the scope of the present invention, applications, or use thereof.

First Embodiment

A first embodiment will be described. The present embodiment is directed to an air conditioner (10) comprised of a refrigeration apparatus having a heat source unit (11).

Figure 1:
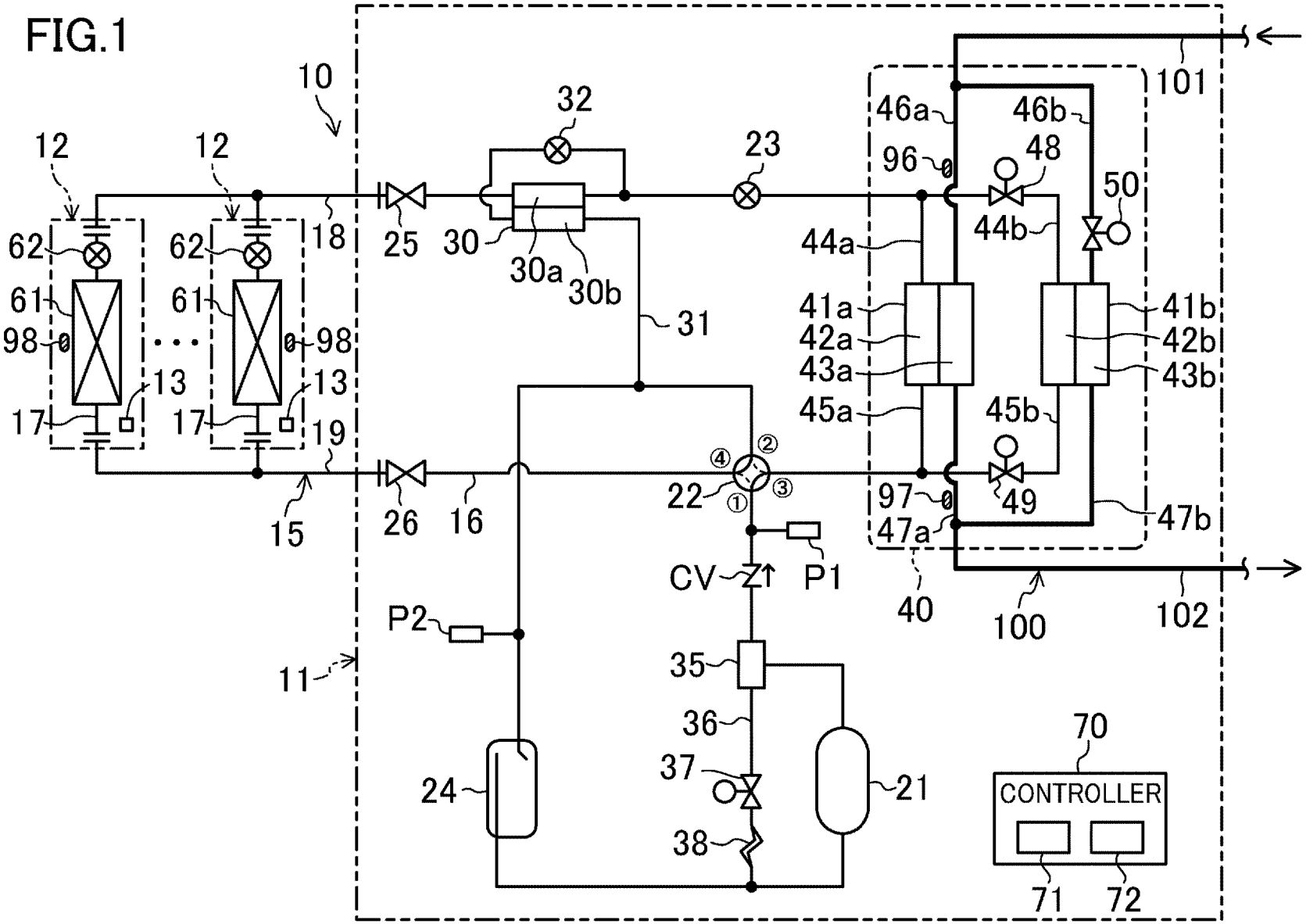
FIG. 1 is a refrigerant circuit diagram illustrating a configuration of an air conditioner according to a first embodiment.

As shown in FIG. 1, the air conditioner (10) of the present embodiment includes a single heat source unit (11) and a plurality of indoor units (12). In this air conditioner (10), the heat source unit (11) and each of the indoor units (12) are connected together through a liquid connection pipe (18) and a gas connection pipe (19) to form a refrigerant circuit (15). A refrigerant fills and circulates in the refrigerant circuit (15) so that a refrigeration cycle is performed.

<Heat Source Unit>

As shown in FIG. 1, the heat source unit (11) houses a heat-source-side circuit (16) and a controller (70). The heat source unit (11) is connected to a heat source water circuit (100) which will be described later. First, the heat-source-side circuit (16) will be described below. The controller (70) and the heat source water circuit (100) will be described later.

The heat-source-side circuit (16) includes a compressor (21), a four-way switching valve (22), a heat-source-side expansion valve (23), an accumulator (24), a liquid-side shutoff valve (25), and a gas-side shutoff valve (26). The heat-source-side circuit (16) is provided with a subcooling heat exchanger (30), a subcooling circuit (31), an oil separator (35), and an oil return pipe (36).

In the heat-source-side circuit (16), the compressor (21) has a discharge pipe connected to a first port of the four-way switching valve (22), and a suction pipe connected to a second port of the four-way switching valve (22) via the accumulator (24). A pipe connecting the compressor (21) and the first port of the four-way switching valve (22) is provided with a check valve (CV). The heat-source-side heat exchanger (40) has a gas end connected to a third port of the four-way switching valve (22), and a liquid end connected to one end of the heat-source-side expansion valve (23). The other end of the heat-source-side expansion valve (23) is connected to the liquid-side shutoff valve (25) via the subcooling heat exchanger (30). A fourth port of the four-way switching valve (22) is connected to the gas-side shutoff valve (26).

The compressor (21) is a hermetic scroll compressor. The four-way switching valve (22) can perform switching between a first state in which the first port communicates with the third port, and the second port communicates with the fourth port (indicated by solid curves FIG. 1), and a second state in which the first port communicates with the fourth port, and the second port communicates with the third port (indicated by broken curves in FIG. 1). The heat-source-side heat exchanger (40) allows the refrigerant in the refrigerant circuit (15) to exchange heat with heat source water in the heat source water circuit (100). A detailed structure of the heat-source-side heat exchanger (40) will be described later. The heat-source-side expansion valve (23) is an electric expansion valve having a variable degree of opening. The check valve (CV) permits the refrigerant to flow from the compressor (21) toward the four-way switching valve (22), and blocks the flow of the refrigerant in the reverse direction.

The subcooling heat exchanger (30) is configured as, for example, a plate-type heat exchanger. The subcooling heat exchanger (30) has a plurality of high pressure channels (30*a*) and a plurality of low pressure channels (30*b*). The subcooling circuit (31) has one end connected to a pipe between the heat-source-side expansion valve (23) and the subcooling heat exchanger (30), and the other end connected to a pipe between the second port of the four-way switching valve (22) and the accumulator (24). The subcooling circuit (31) is provided with a subcooling expansion valve (32). The subcooling expansion valve (32) is an electric expansion valve having a variable degree of opening.

In the subcooling heat exchanger (30), the high pressure channel (30*a*) is arranged between the heat-source-side expansion valve (23) and the liquid-side shutoff valve (25) in the heat-source-side circuit (16), and the low pressure channel (30*b*) is arranged downstream of the subcooling expansion valve (32) in the subcooling circuit (31). The subcooling heat exchanger (30) cools the refrigerant flowing in the high pressure channel (30*a*) through heat exchange with the refrigerant flowing in the low pressure channel (30*b*).

The oil separator (35) is provided for a pipe connecting the discharge pipe of the compressor (21) and the check valve (CV) in the heat-source-side circuit (16). The oil separator (35) separates a refrigeration oil discharged together with a gaseous refrigerant from the compressor (21) from the gaseous refrigerant. The oil return pipe (36) has one end connected to the oil separator (35), and the other end connected between the accumulator (24) and the suction pipe of the compressor (21) in the heat-source-side circuit (16). The oil return pipe (36) is provided with an oil return solenoid valve (37) and a capillary tube (38) arranged in this order from the one end to the other end thereof. The oil return pipe (36) is used to return the refrigeration oil separated from the gaseous refrigerant in the oil separator (35) to the compressor (21).

The heat-source-side circuit (16) is provided with a high pressure sensor (P1) and a low pressure sensor (P2). The high pressure sensor (P1) is arranged between the compressor (21) and the oil separator (35) in the heat-source-side circuit (16), and measures the pressure of the refrigerant discharged from the compressor (21). The low pressure sensor (P2) is arranged between the four-way switching valve (22) and the accumulator (24) in the heat-source-side circuit (16), and measures the pressure of the refrigerant sucked into the compressor (21). The heat-source-side circuit (16) is provided with a plurality of temperature sensors, which are not shown.

<Indoor Unit>

The indoor units (12) constitute utilization-side units. Each indoor unit (12) houses a utilization-side circuit (17) and an indoor controller (13).

Each utilization-side circuit (17) includes an indoor expansion valve (62) serving as a utilization-side expansion valve, and an indoor heat exchanger (61) serving as the utilization-side heat exchanger, which are arranged in this order from the liquid end to the gas end. The indoor expansion valve (62) is an electric expansion valve having a variable degree of opening. The indoor heat exchanger (61) allows the refrigerant to exchange heat with the indoor air.

Although not shown, each indoor unit (12) is provided with a single indoor fan. The indoor fan feeds the indoor air to the indoor heat exchanger (61).

The utilization-side circuit (17) of each indoor unit (12) has a liquid end connected to the liquid-side shutoff valve (25) of the heat-source-side circuit (16) via the liquid connection pipe (18), and a gas end connected to the gas-side shutoff valve (26) of the heat-source-side circuit (16) via the gas connection pipe (19).

The indoor controller (13) of each indoor unit (12) controls the indoor expansion valve (61) and the indoor fan provided for the indoor unit (12). Specifically, the indoor controller (13) regulates the degree of opening of the indoor expansion valve (61) and the rotational speed of the indoor fan.

The indoor heat exchanger (61) of each indoor unit (12) is provided with a utilization-side refrigerant temperature sensor (98). The utilization-side temperature sensor (98) measures the temperature of a gas-liquid two-phase state refrigerant flowing through the heat transfer tube of the indoor heat exchanger (61). Specifically, a measurement of the utilization-side refrigerant temperature sensor (98) is an evaporation temperature of the refrigerant when the indoor heat exchanger (61) functions as an evaporator, and a condensing temperature of the refrigerant when the indoor heat exchanger (61) functions as a condenser.

<Heat-Source-Side Heat Exchanger>

The heat-source-side heat exchanger (40) includes two (first and second) heat exchange sections (41*a*, 41*b*), two (first and second) liquid passages (44*a*, 44*b*), two (first and second) gas passages (45*a*, 45*b*), two (first and second) water introduction channels (46*a*, 46*b*), and two (first and second) water delivery channels (47*a*, 47*b*).

Each of the heat exchange sections (41*a*, 41*b*) is a plate-type heat exchanger. Each of the heat exchange sections (41*a*, 41*b*) is provided with a plurality of refrigerant channels (42*a*, 42*b*) and a plurality of heat source water channels (43*a*, 43*b*). Each of the heat exchange sections (41*a*, 41*b*) allows the refrigerant flowing through an associated one of the refrigerant channels (42*a*, 42*b*) to exchange heat with the heat source water flowing through an associated one of the heat source water channels (43*a*, 43*b*).

The refrigerant channels (42*a*, 42*b*) of the heat exchange sections (41*a*, 41*b*) are connected together in parallel. Specifically, an end of the refrigerant channel (42*a*) of the first heat exchange section (41*a*) is connected to an end of the first liquid passage (44*a*), and an end of the refrigerant channel (42*b*) of the second heat exchange section (41*b*) is connected to an end of the second liquid passage (44*b*). The other end of the first liquid passage (44*a*) and the other end of the second liquid passage (44*b*) constitute a liquid end of the heat-source-side heat exchanger (40), and are connected to a pipe connecting the heat-source-side heat exchanger (40) and the heat-source-side expansion valve (23). Further, the other end of the refrigerant channel (42*a*) of the first heat exchange section (41*a*) is connected to an end of the first gas passage (45*a*), and the other end of the refrigerant channel (42*b*) of the second heat exchange section (41*b*) is connected to an end of the second gas passage (45*b*). The other end of the first gas passage (45*a*) and the other end of the second gas passage (45*b*) constitute a gas end of the heat-source-side heat exchanger (40), and is connected to a pipe connecting the heat-source-side heat exchanger (40) and the third port of the four-way switching valve (22).

A liquid valve (48), which is a solenoid valve, is provided for the second liquid passage (44*b*). A gas valve (49), which is a solenoid valve, is provided for the second gas passage (45*b*). The liquid valve (48) and the gas valve (49) constitute a refrigerant valve mechanism for changing the number of heat exchange sections (41*a*, 41*b*) into which the refrigerant flows.

The heat source water channels (43*a*, 43*b*) of the heat exchange sections (41*a*, 41*b*) are connected together in parallel. Specifically, an end of the heat source water channel (43*a*) of the first heat exchange section (41*a*) is connected to an end of the first water introduction channel (46*a*), and an end of the heat source water channel (43*b*) of the second heat exchange section (41*b*) is connected to an end of the second water introduction channel (46*b*). The other end of the first water introduction channel (46*a*) and the other end of the second water introduction channel (46*b*) are connected to a flow-in pipe (101) of a heat source water circuit (100) which will be described later. The other end of the heat source water channel (43*a*) of the first heat exchange section (41*a*) is connected to an end of the first water delivery channel (47*a*), and the other end of the heat source water channel (43*b*) of the second heat exchange section (41*b*) is connected to an end of the second water delivery channel (47*b*). The other end of the first water delivery channel (47*a*) and the other end of the second water delivery channel (47*b*) are connected to a flow-out pipe (102) of a heat source water circuit (100) which will be described later.

A water valve (50), which is a solenoid valve, is provided for the second water introduction channel (46*b*). The water valve (50) constitutes a water valve mechanism for changing the number of heat exchange sections (41*a*, 41*b*) into which the heat source water flows. The first water introduction channel (46*a*) is provided with an entering water temperature sensor (96). The entering water temperature sensor (96) measures the temperature of the heat source water flowing through the first water introduction channel (46*a*) (i.e., heat source water supplied to the heat source water channel (43*a*) of the first heat exchange section (41*a*)). The first water delivery channel (47*a*) is provided with an exit water temperature sensor (97). The exit water temperature sensor (97) measures the temperature of the heat source water flowing through the first water delivery channel (47*a*) (i.e., the heat source water flowing out of the heat source water channel (43*a*) of the first heat exchange section (41*a*)).

The heat-source-side heat exchanger (40) can be switched between a large capacity state in which both of the first and second heat exchange sections (41*a*) and (41*b*) allow the refrigerant and the heat source water to flow therein, and a small capacity state in which only the first heat exchange section (41*a*) allows the refrigerant and the heat source water to flow therein. Switching between the large capacity state and the small capacity state is performed through operation of the liquid valve (48), the gas valve (49), and the water valve (50).

In the large capacity state, both of the first and second heat exchange sections (41*a*) and (41*b*) function as heat exchange regions in which the refrigerant exchanges heat with the heat source water. In the small capacity state, only the first heat exchange section (41*a*) functions as the heat exchange region in which the refrigerant exchanges heat with the heat source water. Thus, the heat-source-side heat exchanger (40) is able to change the size of the heat exchange region.

<Controller>

A controller (70) provided for the heat source unit (11) constitutes a control device. The controller (70) includes a CPU (71) performing calculations, and a memory (72) storing programs and data for control.

The controller (70) receives measurements of the high pressure sensor (P1), the low pressure sensor (P2), and the entering water temperature sensor (96). The controller (70) also receives a measurement of a temperature sensor (not shown) provided for the heat-source-side circuit. The controller (70) communicates with the indoor controllers (13) respectively provided for the indoor units (12).

Figure 2:
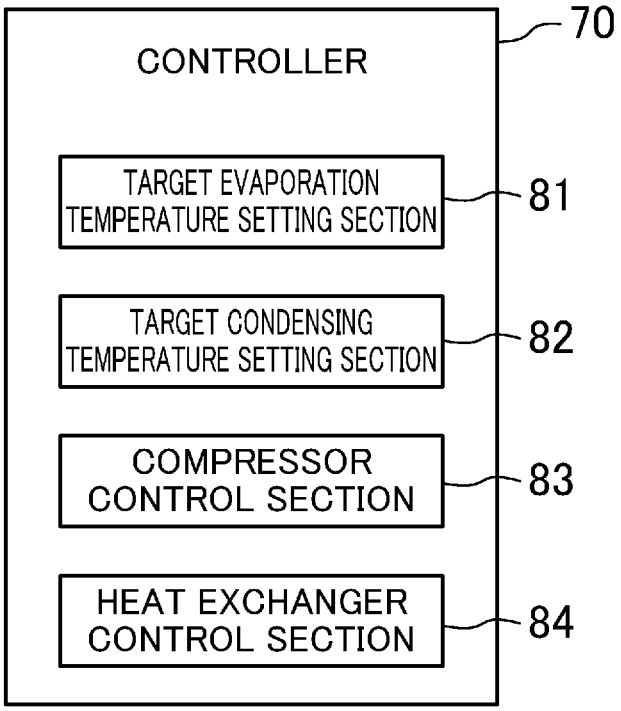
FIG. 2 is a block diagram illustrating a configuration of a controller according to the first embodiment.

As shown in FIG. 2, the controller (70) includes a target evaporation temperature setting section (81), a target condensing temperature setting section (82), a compressor control section (83), and a heat exchanger control section (84). The controller (70) also regulates the degrees of opening of the heat-source-side expansion valve (23) and the subcooling expansion valve (32), and controls the four-way switching valve (22) and the oil return solenoid valve (37).

The target evaporation temperature setting section (81) sets a target value Te_t of the evaporation temperature of the refrigerant in the indoor heat exchanger (61) in the cooling operation. The target condensing temperature setting section (82) sets a target value Tc_t of the condensing temperature of the refrigerant in the indoor heat exchanger (61) in the heating operation. The compressor control section (83) controls an operation frequency of the compressor (21) (i.e., a frequency of an alternating current supplied to the electric motor of the compressor (21)) to adjust the operation capacity (i.e., rotational speed) of the compressor (21). The heat exchanger control section (84) controls the liquid valve (48), the gas valve (49), and the water valve (50) provided for the heat-source-side heat exchanger (40). Details of the operation of the target evaporation temperature setting section (81), the target condensing temperature setting section (82), the compressor control section (83), and the heat exchanger control section (84) will be described later.

<Heat Source Water Circuit>

The heat source water circuit (100) allows the heat source water to circulate therein. The heat source water circuit (100) includes a flow-in pipe (101) through which the heat source water is supplied to the heat source unit (11), and a flow-out pipe (102) through which the heat source water flows out of the heat source unit (11). Although not shown, the heat source water circuit (100) includes a pump for the circulation of the heat source water.

When the air conditioner (10) is performing the cooling operation, the heat source water circuit (100) allows the heat source water to circulate between the heat-source-side heat exchanger (40) of the heat source unit (11) and a cold thermal energy source such as a cooling tower, and supplies the heat source water cooled through the cold thermal energy source to the heat-source-side heat exchanger (40). When the air conditioner (10) is performing the heating operation, the heat source water circuit (100) allows the heat source water to circulate between the heat-source-side heat exchanger (40) of the heat source unit (11) and a warm thermal energy source such as a boiler, and supplies the heat source water heated through the warm thermal energy source to the heat-source-side heat exchanger (40).

—Operation of Air Conditioner—

The air conditioner (10) of this embodiment selectively performs cooling of the indoor space (cooling operation) and heating of the indoor space (heating operation).

<Cooling Operation>

During the cooling operation, the refrigerant circulates in the refrigerant circuit (15), and a refrigeration cycle is performed in which the heat-source-side heat exchanger (33) functions as a condenser (radiator), and the indoor heat exchanger (61) functions as an evaporator. In the cooling operation of the air conditioner (10), the heat source unit (11) performs a cooling action in which the heat-source-side heat exchanger (40) functions as a condenser to cool a target (indoor air) in the indoor unit (12).

In the cooling operation, the four-way switching valve (22) is set to the first state indicated by solid curves in FIG. 1, and the degrees of opening of the subcooling expansion valve (32) and the indoor expansion valve (61) are appropriately regulated. In this example, it will be described below how the air conditioner (10) performs the cooling operation with the liquid valve (48), the gas valve (49), and the water valve (50) of the heat-source-side heat exchanger (40) open.

The refrigerant discharged from the compressor (21) flows into the heat-source-side heat exchanger (40) through the four-way switching valve (22). In the heat-source-side heat exchanger (40), a portion of the refrigerant flows into the refrigerant channel (42*a*) of the first heat exchange section (41*a*), and the rest of the refrigerant flows into the refrigerant channel (42*b*) of the second heat exchange section (41*b*). The heat source water cooled by the cold thermal energy source is supplied to the heat source water channels (43*a*, 43*b*) of the heat exchange sections (41*a*, 41*b*) via the flow-in pipe (101). In the heat exchange sections (41*a*, 41*b*), flows of the refrigerant in the refrigerant channels (42*a*, 42*b*) are condensed through dissipation of heat to flows of the heat source water in the heat source water channels (43*a*, 43*b*). Flows of the refrigerant condensed in the heat exchange sections (41*a*, 41*b*) merge into a single flow, which passes through the heat-source-side expansion valve (23).

A portion of the refrigerant that has passed through the heat-source-side expansion valve (23) flows into the subcooling circuit (31), and the rest of the refrigerant flows into the high pressure channel (30*a*) of the subcooling heat exchanger (30). The refrigerant that flowed into the subcooling circuit (31) expands as it passes through the subcooling expansion valve (32), and then flows into the low pressure channel (30*b*) of the subcooling heat exchanger (30). In the subcooling heat exchanger (30), the refrigerant flowing through the high pressure channel (30*a*) is cooled as a result of heat exchange with the refrigerant flowing through the low pressure channel (30*b*). The refrigerant flowing through the low pressure channel (30*b*) evaporates through absorption of heat from the refrigerant flowing through the high pressure channel (30*a*).

The refrigerant that has been cooled in the high pressure channel (30*a*) of the subcooling heat exchanger (30) is distributed to the utilization-side circuits (17) through the liquid connection pipe (18). In each of the utilization-side circuits (17), the refrigerant flowed therein expands as it passes through the indoor expansion valve (62), and then evaporates through absorption of heat from the indoor air in the indoor heat exchanger (61). Each of the indoor units (12) blows the air that has been cooled in the indoor heat exchanger (61) into the indoor space. Flows of the refrigerant that has evaporated in the indoor heat exchangers (61) merge into a single flow in the gas connection pipe (19), which then flows into the heat-source-side circuit (16). Thereafter, the refrigerant passes through the four-way switching valve (22) and then merges with the refrigerant in the subcooling circuit (31), and the merged refrigerant is sucked into the compressor (21) via the accumulator (24). The compressor (21) compresses the refrigerant sucked therein, and discharges the refrigerant thus compressed.

<Heating Operation>

In the heating operation, the refrigerant circulates in the refrigerant circuit (15), and a refrigeration cycle is performed in which the indoor heat exchanger (61) functions as a condenser (radiator), and the heat-source-side heat exchanger (40) functions as an evaporator. In the heating operation of the air conditioner (10), the heat source unit (11) performs a heating action in which the heat-source-side heat exchanger (40) functions as an evaporator to heat a target (indoor air) in the indoor unit (12).

In the heating operation, the four-way switching valve (22) is set to the second state indicated by broken curves in FIG. 1, and the degrees of opening of the heat-source-side expansion valve (23), the subcooling expansion valve (32) and the indoor expansion valve (61) are appropriately regulated. In this example, it will be described below how the air conditioner (10) performs the heating operation with the liquid valve (48), gas valve (49), and water valve (50) of the heat-source-side heat exchanger (40) open.

The refrigerant discharged from the compressor (21) passes through the four-way switching valve (22) and the gas connection pipe (19), and is distributed to the utilization-side circuits (17). In each of the utilization-side circuits (17), the refrigerant flowed therein dissipates heat to the indoor air in the indoor heat exchanger (61). Each of the indoor units (12) blows the air that has been heated in the indoor heat exchanger (61) into the indoor space. Flows of the refrigerants that have been condensed in the indoor heat exchangers (61) pass through the indoor expansion valves (62), merge into a single flow in the liquid connection pipe (18), which then flows into the heat-source-side circuit (16).

The refrigerant that has flowed into the heat-source-side circuit (16) flows into the high pressure channel (30*a*) of the subcooling heat exchanger (30), and is cooled by the refrigerant flowing through the low pressure channel (30*b*). A portion of the refrigerant that has been cooled in the high pressure channel (30*a*) of the subcooling heat exchanger (30) flows into the subcooling circuit (31), and the rest of the refrigerant flows into the heat-source-side expansion valve (23). The refrigerant that flowed into the subcooling circuit (31) expands as it passes through the subcooling expansion valve (32), and then flows into the low pressure channel (30*b*) of the subcooling heat exchanger (30). The refrigerant flowing through the low pressure channel (30*b*) evaporates through absorption of heat from the refrigerant flowing through the high pressure channel (30*a*).

The refrigerant that has flowed into the heat-source-side expansion valve (23) expands as it passes through the heat-source-side expansion valve (23), and then flows into the heat-source-side heat exchanger (40). In the heat-source-side heat exchanger (40), a portion of the refrigerant flows into the refrigerant channel (42*a*) of the first heat exchange section (41*a*), and the rest of the refrigerant flows into the refrigerant channel (42*b*) of the second heat exchange section (41*b*). The heat source water heated by the warm thermal energy source is supplied to the heat source water channels (43*a*, 43*b*) of the heat exchange sections (41*a*, 41*b*) via the flow-in pipe (101). In the heat exchange sections (41*a*, 41*b*), flows of the refrigerant in the refrigerant channels (42*a*, 42*b*) evaporate through dissipation of heat from the heat source water in the heat source water channels (43*a*, 43*b*).

The flows of the refrigerant that have evaporated in the heat exchange sections (41*a*, 41*b*) merge into a single flow, which passes through the four-way switching valve (22), and then merges with the refrigerant in the subcooling circuit (31). Then, the merged refrigerant is sucked into the compressor (21) via the accumulator (24). The compressor (21) compresses the refrigerant sucked therein, and discharges the refrigerant thus compressed.

—Control by Controller—

Control performed by the controller (70) will be described below. First, how the target evaporation temperature setting section (81), the target condensing temperature setting section (82), the compressor control section (83), and the heat exchanger control section (84) operate will be described below.

<Target Evaporation Temperature Setting Section>

The target evaporation temperature setting section (81) sets a target value Te_t of the evaporation temperature of the refrigerant in the indoor heat exchanger (61) during the cooling operation.

For each of the indoor units (12) in the cooling operation, the indoor controller (13) calculates an evaporation temperature of the refrigerant at which the indoor unit (12) can exhibit a required cooling capability, and sends the calculated value to the controller (70) of the heat source unit (11) as a required value of the evaporation temperature of the refrigerant. The indoor controller (13) calculates the required value of the evaporation temperature of the refrigerant based on the conditions, such as the temperature of the indoor heat exchanger (61), and the rotational speed of the indoor fan. Specifically, the indoor controller (13) calculates the required value of the evaporation temperature of the refrigerant in view of the cooling load of the indoor unit (12) for which the indoor controller (13) is provided.

The target evaporation temperature setting section (81) of the controller (70) compares the required values of the evaporation temperature of the refrigerant sent from the indoor controllers (13) of the indoor units (12), and sets the lowest value as the target value of the evaporation temperature of the refrigerant (i.e., the target evaporation temperature Te_t).

As described above, the required value of the evaporation temperature of the refrigerant sent from the indoor controller (13) is calculated in view of the cooling load of the indoor unit (12). Thus, the target evaporation temperature Te_t which is determined based on the required value of the evaporation temperature of the refrigerant sent from the indoor controller (13) is a value determined in view of the cooling load of the air conditioner (10). The target evaporation temperature Te_t increases with the decrease, or decreases with the increase, in the cooling load of the air conditioner (10).

<Target Condensing Temperature Setting Section>

The target condensing temperature setting section (82) sets a target value Tc_t of the condensing temperature of the refrigerant in the indoor heat exchanger (61) during the heating operation.

For each of the indoor units (12) in the heating operation, the indoor controller (13) calculates a condensing temperature of the refrigerant at which the indoor unit (12) can exhibit a required heating capability, and sends the calculated value to the controller (70) of the heat source unit (11) as a required value of the condensing temperature of the refrigerant. Specifically, the indoor controller (13) calculates the required value of the condensing temperature of the refrigerant based on the conditions, such as the temperature of the indoor heat exchanger (61), and the rotational speed of the indoor fan. In other words, the indoor controller (13) calculates the required value of the condensing temperature of the refrigerant in view of the heating load of the indoor unit (12) for which the indoor controller (13) is provided.

The target condensing temperature setting section (82) of the controller (70) compares the required values of the condensing temperature of the refrigerant sent from the indoor controllers (13) of the indoor units (12), and sets the highest value as the target value of the condensing temperature of the refrigerant (i.e., the target condensing temperature Tc_t).

As described above, the required value of the condensing temperature of the refrigerant sent from the indoor controller (13) is calculated in view of the heating load of the indoor unit (12). Thus, the target condensing temperature Tc_t which is determined based on the required value of the condensing temperature of the refrigerant sent from the indoor controller (13) is a value determined in view of the heating load of the air conditioner (10). The target condensing temperature Tc_t decreases with the decrease, or increases with the increase, in the heating load of the air conditioner (10).

<Compressor Control Section>

The compressor control section (83) controls the operation frequency of the compressor (21) to adjust the operation capacity of the compressor (21).

In the cooling operation, the compressor control section (83) adjusts the operation capacity of the compressor (21) based on the target evaporation temperature Te_t determined by the target evaporation temperature setting section (81). Specifically, the compressor control section (83) calculates a saturation pressure of the refrigerant at the target evaporation temperature Te_t (i.e., a pressure at which the saturation temperature of the refrigerant reaches the target evaporation temperature Te_t), and determines the calculated value to be a target evaporation pressure Pe_t. Then, the compressor control section (83) controls the operation frequency of the compressor (21) so that the measurement of the low pressure sensor (P2) reaches the target evaporation pressure Pe_t. Specifically, the compressor control section (83) lowers the operation frequency of the compressor (21) if the measurement of the low pressure sensor (P2) is lower than the target evaporation pressure Pe_t, and increases the operation frequency of the compressor (21) if the measurement of the low pressure sensor (P2) is higher than the target evaporation pressure Pe_t.

In the heating operation, the compressor control section (83) adjusts the operation capacity of the compressor (21) based on the target condensing temperature Tc_t determined by the target condensing temperature setting section (82). Specifically, the compressor control section (83) calculates a saturation pressure of the refrigerant at the target condensing temperature Tc_t (i.e., a pressure at which the saturation temperature of the refrigerant reaches the target condensing temperature Tc_t), and determines the calculated value to be a target condensing pressure Pc_t. Then, the compressor control section (83) adjusts the operation frequency of the compressor (21) so that the measurement of the high pressure sensor (P1) reaches the target condensing pressure Pc_t. Specifically, the compressor control section (83) lowers the operation frequency of the compressor (21) if the measurement of the high pressure sensor (P1) is higher than the target condensing pressure Pc_t, and increases the operation frequency of the compressor (21) if the measurement of the high pressure sensor (P1) is lower than the target condensing pressure Pc_t.

<Heat Exchanger Control Section>

The heat exchanger control section (84) adjusts the size of the heat exchange region of the heat-source-side heat exchanger (40) based on the measurement of the entering water temperature sensor (96). The heat exchanger control section (84) controls the liquid valve (48), the gas valve (49), and the water valve (50) provided for the heat-source-side heat exchanger (40) to change the number of heat exchange sections (41*a*, 41*b*) through which the refrigerant and the heat source water flow, thereby adjusting the size of the heat exchange region of the heat-source-side heat exchanger (40).

The heat-source-side heat exchanger (40) of this embodiment includes two heat exchange sections (41*a*, 41*b*). The heat exchanger control section (84) of this embodiment switches the heat-source-side heat exchanger (40) between a large capacity state in which the refrigerant and the heat source water flow through both of the first and second heat exchange sections (41*a*) and (41*b*), and a small capacity state in which the refrigerant and the heat source water flow only through the first heat exchange section (41*a*) and the second heat exchange section (41*b*) rests.

Figure 3:
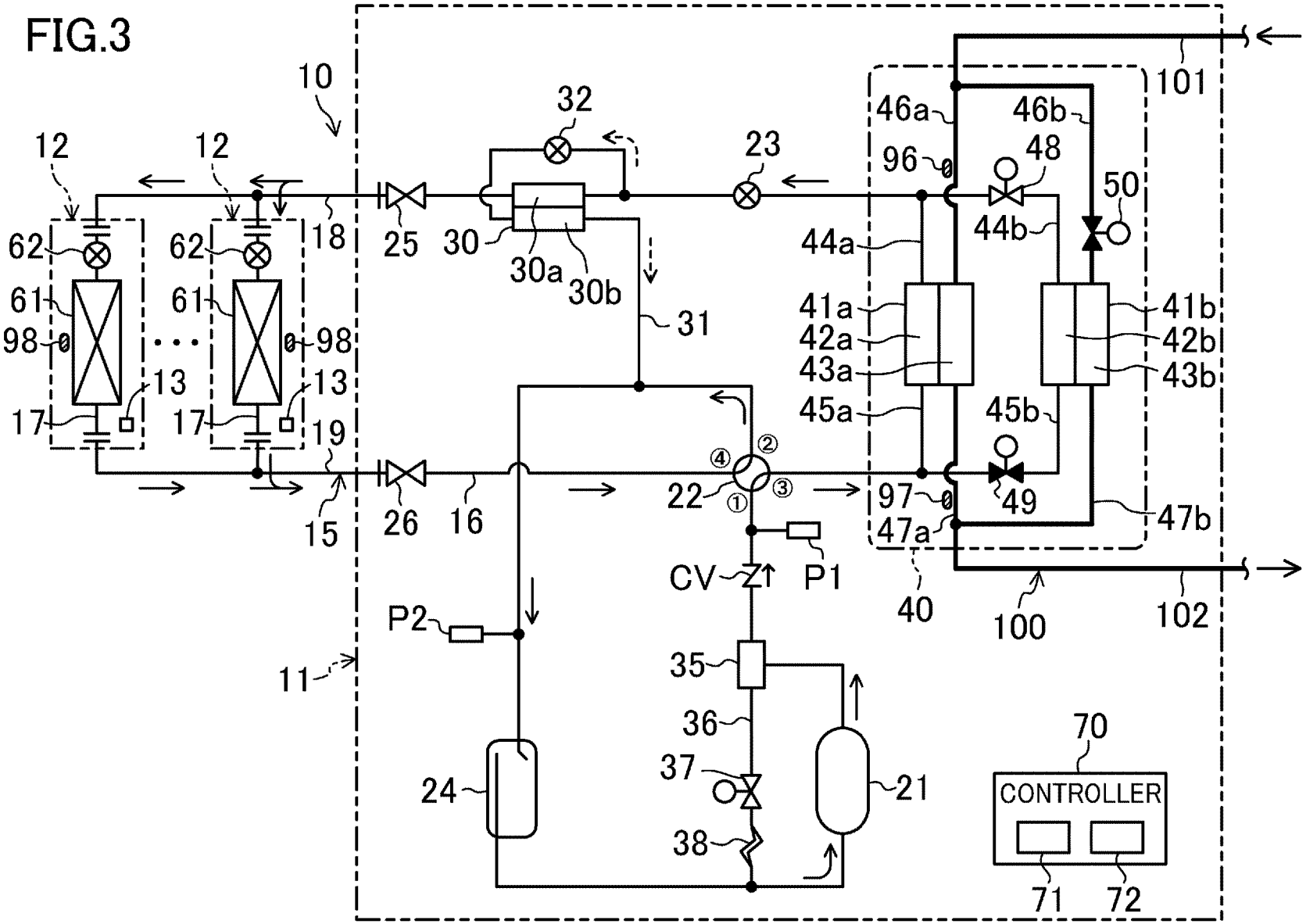
FIG. 3 is a refrigerant circuit diagram illustrating the air conditioner of the first embodiment during a cooling operation, in which a heat-source-side heat exchanger is in a small capacity state.

When the heat source unit (11) is performing the cooling action (i.e., during the cooling operation of the air conditioner (10)), the heat exchanger control section (84) opens the liquid valve (48), the gas valve (49), and the water valve (50) to set the heat-source-side heat exchanger (40) to the large capacity state. Further, when the heat source unit (11) is performing the cooling action, the heat exchanger control section (84) closes the gas valve (49) and the water valve (50), and opens the water valve (48) as shown in FIG. 3, thereby setting the heat-source-side heat exchanger (40) to the small capacity state. In this way, during the cooling action of the heat source unit (11), the heat exchanger control section (84) switches the gas valve (49) and the water valve (50) between on and off, while keeping the liquid valve (48) open.

Figure 4:
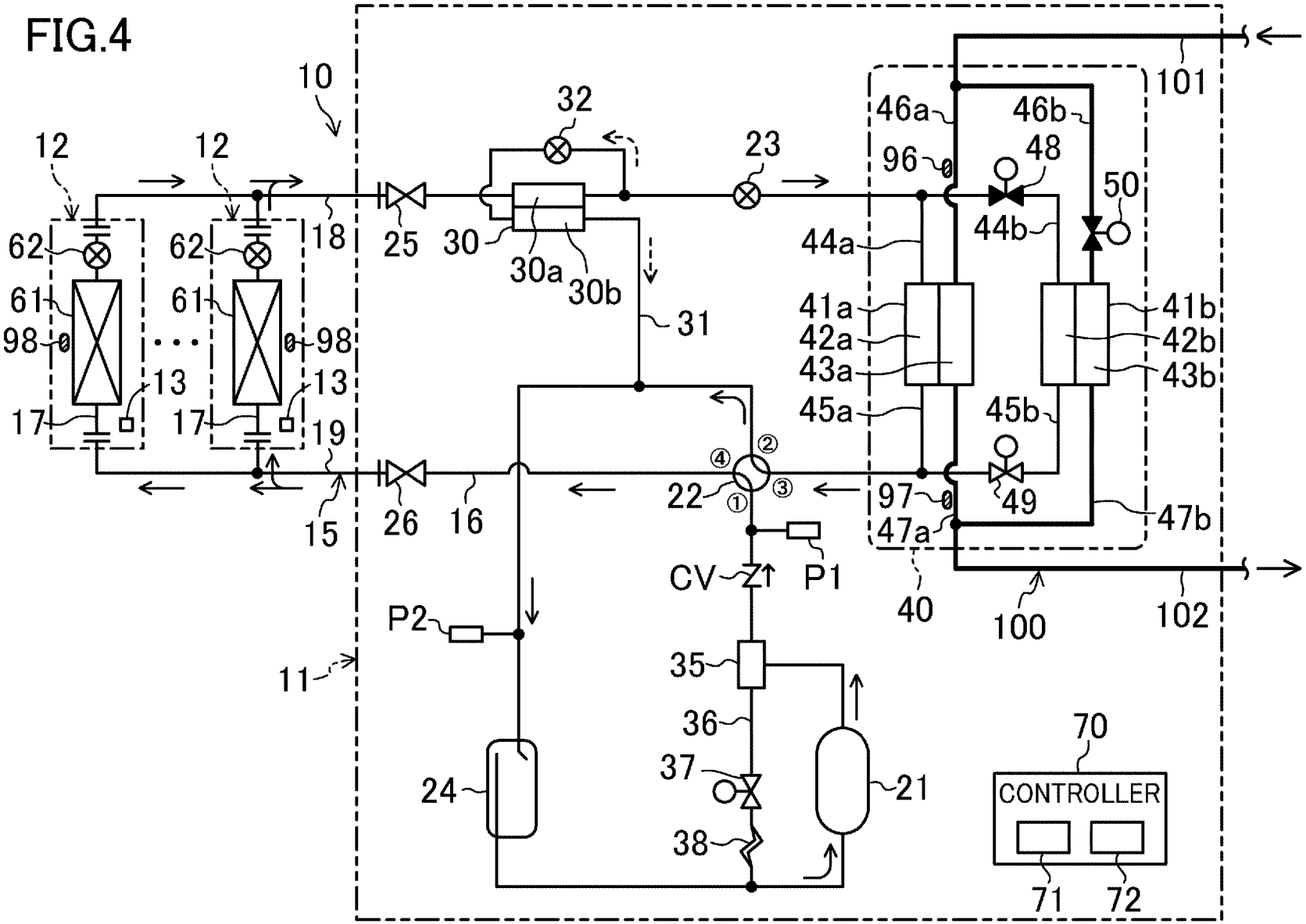
FIG. 4 is a refrigerant circuit diagram illustrating the air conditioner of the first embodiment during a heating operation, in which a heat-source-side heat exchanger is in a small capacity state.

When the heat source unit (11) is performing the heating action (i.e., during the heating operation of the air conditioner (10)), the heat exchanger control section (84) opens the liquid valve (48), the gas valve (49), and the water valve (50) to set the heat-source-side heat exchanger (40) to the large capacity state. Further, when the heat source unit (11) is performing the heating action, the heat exchanger control section (84) closes the liquid valve (48) and the water valve (50), and opens the gas valve (49) as shown in FIG. 4, thereby setting the heat-source-side heat exchanger (40) to the small capacity state. In this way, during the heating action of the heat source unit (11), the heat exchanger control section (84) switches the liquid valve (48) and the water valve (50) between on and off, while keeping the gas valve (49) open.

As described above, the heat exchanger control section (84) adjusts the size of the heat exchange region of the heat-source-side heat exchanger (40) based on the measurement of the entering water temperature sensor (96). That is, the heat exchanger control section (84) performs control of switching the heat-source-side heat exchanger (40) between the large capacity state and the small capacity state based on the measurement of the entering water temperature sensor (96). The heat exchanger control section (84) performs the control every predetermined time.

The control performed by the heat exchanger control section (84) will be described below with reference to the flowchart shown in FIG. 5. As will be described later, during the cooling operation of the air conditioner (10), the heat exchanger control section (84) uses a difference (Tw_i−Te_t) between an entering water temperature Tw_i and the target evaporation temperature Te_t as a differential pressure index value, and adjusts the size of the heat exchange region of the heat-source-side heat exchanger (40) so that the differential pressure index value becomes equal to or more than a reference temperature difference ΔTs_c, which is a reference index value. Further, during the heating operation of the air conditioner (10), the heat exchanger control section (84) uses a difference (Tc_t−Tw_i) between the target condensing temperature Tc_t and the entering water temperature Tw_i as a differential pressure index value, and adjusts the size of the heat exchange region of the heat-source-side heat exchanger (40) so that the differential pressure index value becomes equal to or more than a reference temperature difference ΔTs_h, which is a reference index value.

First, in Step ST10, the heat exchanger control section (84) determines whether the air conditioner (10) is performing the cooling operation or not. If it is determined that the air conditioner (10) is not performing the cooling operation, the process proceeds to Step ST20, and the heat exchanger control section (84) determines whether the air conditioner (10) is performing the heating operation or not. If it is determined in Step ST20 that the air conditioner (10) is not performing the heating operation, it is determined that the air conditioner (10) neither performs the cooling operation nor the heating operation. Therefore, the heat exchanger control section (84) finishes the control.

If it is determined in Step ST10 that the air conditioner (10) is performing the cooling operation, the process proceeds to Step ST11, and the heat exchanger control section (84) reads the entering water temperature Tw_i, which is the measurement of the entering water temperature sensor (96) (the temperature of the heat source water supplied to the heat-source-side heat exchanger (40) from the heat source water circuit (100) via the flow-in pipe (101)), and the target evaporation temperature Te_t set by the target evaporation temperature setting section (81). In the subsequent Step ST12, the heat exchanger control section (84) compares the difference (Tw_i−Te_t) between the entering water temperature Tw_i and the target evaporation temperature Te_t with the reference temperature difference ΔTs_c for the cooling operation. The reference temperature difference ΔTs_c is 9° C., for example.

If the value (Tw_i−Te_t) is less than ΔTs_c (i.e., (Tw_i−Te_t)<ΔTs_c) in Step ST12, the temperature of the heat source water supplied to the heat-source-side heat exchanger (40) is relatively low, and the capability of the heat-source-side heat exchanger (40) serving as the condenser is excessive. This may possibly lower the high pressure of the refrigeration cycle (i.e., condensing pressure of the refrigerant) too much. Further, since the value (Tw_i−Te_t) as the differential pressure index value is small, the difference between the high pressure and low pressure of the refrigeration cycle may become too small. Therefore, in such a case, it is desired that the capability of the heat-source-side heat exchanger (40) is lowered. In this case, the process proceeds to Step ST13, and the heat exchanger control section (84) determines whether the gas valve (49) and the water valve (50) are open or not.

If the gas valve (49) and the water valve (50) are open, the refrigerant and the heat source water flow through both of the first and second heat exchange sections (41*a*) and (41*b*) of the heat-source-side heat exchanger (40). That is, the heat-source-side heat exchanger (40) is in the large capacity state in which both of the first and second heat exchange sections (41*a*) and (41*b*) function as condensers. Therefore, in such a case, the capability of the heat-source-side heat exchanger (40) can be lowered.

Thus, if it is determined in Step ST13 that the gas valve (49) and the water valve (50) are open, the process proceeds to Step ST14, and the heat exchanger control section (84) closes the gas valve (49) and the water valve (50). Once the gas valve (49) and the water valve (50) are closed, the refrigerant and the heat source water flow only through the first heat exchange section (41*a*) of the heat-source-side heat exchanger (40). That is, the heat-source-side heat exchanger (40) is in the small capacity state in which only the first heat exchange section (41*a*) functions as a condenser and the second heat exchange section (41*b*) rests.

If the gas valve (49) and the water valve (50) are closed, the capability of the heat-source-side heat exchanger (40) cannot be lowered because the heat-source-side heat exchanger (40) is already in the small capacity state. Thus, in this case, the heat exchanger (84) finishes the control.

If the value (Tw_i−Te_t) is equal to or more than ΔTs_c (i.e., (Tw_i−Te_t)<ΔTs_c is not met) in Step ST12, the temperature of the heat source water supplied to the heat-source-side heat exchanger (40) is relatively high, and the capability of the heat-source-side heat exchanger (40) serving as the condenser is insufficient. This may possibly raise the high pressure of the refrigeration cycle (i.e., condensing pressure of the refrigerant) too much. Further, since the value (Tw_i−Te_t) as the differential pressure index value is large, the difference between the high pressure and low pressure of the refrigeration cycle may become too large, which may increase the power consumption of the compressor (21). Therefore, in such a case, it is desired that the capability of the heat-source-side heat exchanger (40) is increased. In this case, the process proceeds to Step ST15, and the heat exchanger control section (84) determines whether the gas valve (49) and the water valve (50) are closed or not.

When the gas valve (49) and the water valve (50) are closed, the refrigerant and the heat source water flow only through the first heat exchange section (41*a*) of the heat-source-side heat exchanger (40). That is, the heat-source-side heat exchanger (40) is in the small capacity state in which only the first heat exchange section (41*a*) functions as a condenser and the second heat exchange section (41*b*) rests. Therefore, in such a case, the capability of the heat-source-side heat exchanger (40) can be increased.

Thus, if it is determined in Step ST15 that the gas valve (49) and the water valve (50) are closed, the process proceeds to Step ST16, and the heat exchanger control section (84) opens the gas valve (49) and the water valve (50). Once the gas valve (49) and the water valve (50) are opened, the refrigerant and the heat source water flow through both of the first and second heat exchange sections (41*a*) and (41*b*) of the heat-source-side heat exchanger (40). That is, the heat-source-side heat exchanger (40) is in the large capacity state in which both of the first and second heat exchange sections (41*a*) and (41*b*) function as condensers.

If the gas valve (49) and the water valve (50) are open, the capability of the heat-source-side heat exchanger (40) cannot be increased anymore because the heat-source-side heat exchanger (40) is already in the large capacity state. Thus, in this case, the heat exchanger (84) finishes the control.

If it is determined in Step ST20 that the air conditioner (10) is performing the heating operation, the process proceeds to Step ST21, and the heat exchanger control section (84) reads the entering water temperature Tw_i, which is the measurement of the entering water temperature sensor (96), and the target condensing temperature Tc_t set by the target condensing temperature setting section (82). In the subsequent Step ST22, the heat exchanger control section (84) compares the difference (Tc_t−Tw_i) between the target condensing temperature Tc_t and the entering water temperature Tw_i with the reference temperature difference ΔTs_h for the heating operation. The reference temperature difference ΔTs_h is 2° C., for example.

If the value (Tc_t−Tw_i) is less than ΔTs_h (i.e., (Tc_t−Tw_i)<ΔTs_h) in Step ST22, the temperature of the heat source water supplied to the heat-source-side heat exchanger (40) is relatively high, and the capability of the heat-source-side heat exchanger (40) serving as the evaporator is excessive. This may possibly increase the low pressure of the refrigeration cycle (i.e., evaporation pressure of the refrigerant) too much. Further, since the value (Tc_t−Tw_i) as the differential pressure index value is small, the difference between the high pressure and low pressure of the refrigeration cycle may become too small. Therefore, in such a case, it is desired that the capability of the heat-source-side heat exchanger (40) is lowered. In this case, the process proceeds to Step ST23, and the heat exchanger control section (84) determines whether the liquid valve (48) and the water valve (50) are open or not.

If the liquid valve (48) and the water valve (50) are open, the refrigerant and the heat source water flow through both of the first and second heat exchange sections (41*a*) and (41*b*) of the heat-source-side heat exchanger (40). That is, the heat-source-side heat exchanger (40) is in the large capacity state in which both of the first and second heat exchange sections (41*a*) and (41*b*) function as evaporators. Therefore, in such a case, the capability of the heat-source-side heat exchanger (40) can be lowered.

Thus, if it is determined in Step ST23 that the liquid valve (48) and the water valve (50) are open, the process proceeds to Step ST24, and the heat exchanger control section (84) closes the liquid valve (48) and the water valve (50). Once the liquid valve (48) and the water valve (50) are closed, the refrigerant and the heat source water flow only through the first heat exchange section (41*a*) of the heat-source-side heat exchanger (40). That is, the heat-source-side heat exchanger (40) is in the small capacity state in which only the first heat exchange section (41*a*) functions as an evaporator and the second heat exchange section (41*b*) rests.

If the liquid valve (48) and the water valve (50) are closed, the capability of the heat-source-side heat exchanger (40) cannot be lowered anymore because the heat-source-side heat exchanger (40) is already in the small capacity state. Thus, in this case, the heat exchanger (84) finishes the control.

If the value (Tc_t−Tw_i) is equal to or more than ΔTs_h (i.e., (Tc_t−Tw_i)<ΔTs_h is not met) in Step ST22, the temperature of the heat source water supplied to the heat-source-side heat exchanger (40) is relatively low, and the capability of the heat-source-side heat exchanger (40) serving as the evaporator is insufficient. This may possibly lower the low pressure of the refrigeration cycle (i.e., evaporation pressure of the refrigerant) too much. Further, since the value (Tc_t−Tw_i) as the differential pressure index value is large, the difference between the high pressure and low pressure of the refrigeration cycle may become too large, which may increase the power consumption of the compressor (21). Therefore, in such a case, it is desired that the capability of the heat-source-side heat exchanger (40) is increased. In this case, the process proceeds to Step ST25, and the heat exchanger control section (84) determines whether the liquid valve (48) and the water valve (50) are closed or not.

When the liquid valve (48) and the water valve (50) are closed, the refrigerant and the heat source water flow only through the first heat exchange section (41*a*) of the heat-source-side heat exchanger (40). That is, the heat-source-side heat exchanger (40) is in the small capacity state in which only the first heat exchange section (41*a*) functions as an evaporator and the second heat exchange section (41*b*) rests. Therefore, in such a case, the capability of the heat-source-side heat exchanger (40) can be increased.

If it is determined in Step ST25 that the liquid valve (48) and the water valve (50) are closed, the process proceeds to Step ST26, and the heat exchanger control section (84) opens the liquid valve (48) and the water valve (50). Once the liquid valve (48) and the water valve (50) are opened, the refrigerant and the heat source water flow through both of the first and second heat exchange sections (41*a*) and (41*b*) of the heat-source-side heat exchanger (40). That is, the heat-source-side heat exchanger (40) is in the large capacity state in which both of the first and second heat exchange sections (41*a*) and (41*b*) function as evaporators.

If the liquid valve (48) and the water valve (50) are open, the capability of the heat-source-side heat exchanger (40) cannot be increased anymore because the heat-source-side heat exchanger (40) is already in the large capacity state. Thus, in this case, the heat exchanger (84) finishes the control.

—Differential Pressure Index Value—

As described above, during the cooling operation of the air conditioner (10), the heat exchanger control section (84) uses the difference (Tw_i−Te_t) between the entering water temperature Tw_i and the target evaporation temperature Te_t as the differential pressure index value. The condensing temperature of the refrigerant in the heat-source-side heat exchanger (40) is generally higher than the entering water temperature Tw_i by a certain value. Further, the condensing temperature of the refrigerant in the heat-source-side heat exchanger (40) correlates with the high pressure of the refrigeration cycle, and the evaporation temperature of the refrigerant in the indoor unit (12) correlates with the low pressure of the refrigeration cycle. Thus, the difference (Tw_i−Te_t) between the entering water temperature Tw_i and the target evaporation temperature Te_t increases with the increase, or decreases with the decrease, in the difference between the high pressure and low pressure of the refrigeration cycle. Thus, the value (Tw_i−Te_t) can be a differential pressure index value indicating the difference between the high pressure and low pressure of the refrigeration cycle performed in the refrigerant circuit (15).

Further, as described above, during the heating operation of the air conditioner (10), the heat exchanger control section (84) uses the difference (Tc_t−Tw_i) between the target condensing temperature Tc_t the entering water temperature Tw_i as the differential pressure index value. The evaporation temperature of the refrigerant in the heat-source-side heat exchanger (40) is generally lower than the entering water temperature Tw_i by a certain value. Further, the condensing temperature of the refrigerant in the indoor unit (12) correlates with the high pressure of the refrigeration cycle, and the evaporation temperature of the refrigerant in the heat-source-side heat exchanger (40) correlates with the low pressure of the refrigeration cycle. Thus, the difference (Tc_t−Tw_i) between the target condensing temperature Tc_t and the entering water temperature Tw_i increases with the increase, or decreases with the decrease, in the difference between the high pressure and low pressure of the refrigeration cycle. Thus, the value (Tc_t−Tw_i) can be a differential pressure index value indicating the difference between the high pressure and low pressure of the refrigeration cycle performed in the refrigerant circuit (15).

Advantages of First Embodiment

In the cooling operation of the air conditioner (10), if the temperature of the heat source water is relatively low, the capability of the heat-source-side heat exchanger (40) serving as the condenser is excessive, and the high pressure of the refrigeration cycle is lowered. As a result, the difference between the high pressure and low pressure of the refrigeration cycle may become too small, and the refrigeration cycle may become hard to continue. This may probably happen particularly when the cooling load of the air conditioner (10) is low.

Further, if the temperature of the heat source water is relatively high in the heating operation of the air conditioner (10), the capability of the heat-source-side heat exchanger (40) serving as the evaporator is excessive, and the low pressure of the refrigeration cycle increases. As a result, the difference between the high pressure and low pressure of the refrigeration cycle becomes too small, and the refrigeration cycle may become hard to continue. This may probably happen particularly when the heating load of the air conditioner (10) is low.

If the refrigeration cycle cannot be continued, the air conditioner (10) will repeat start and stop. If the air conditioner (10) frequently repeats the start and the stop, problems may occur, for example, the temperature of the indoor space varies to make the indoor space less comfortable, or the compressor (21) may easily break due to repeated start and stop.

In view of such problems, according to the air conditioner (10) of this embodiment, the heat exchanger control section (84) of the controller (70) switches the heat-source-side heat exchanger (40) between the large capacity state and the small capacity state based on the entering water temperature Tw_i, which is the measurement of the entering water temperature sensor (96), i.e., the temperature of the heat source water supplied to the heat-source-side heat exchanger (40). Specifically, the heat exchanger control section (84) adjusts the size of the heat exchange region of the heat-source-side heat exchanger (40) based on the difference (Tw_i−Te_t) between the entering water temperature Tw_i and the target evaporation temperature Te_t used as the differential pressure index value for the cooling operation, and on the difference (Tc_t−Tw_i) between the target condensing temperature Tc_t and the entering water temperature Tw_i used as the differential pressure index value for the heating operation.

Thus, even if the entering water temperature Tw_i is in "a temperature range where the capability of the heat-source-side heat exchanger (40) is excessive and the refrigeration cycle may probably become hard to continue unless the size of the heat exchange region of the heat-source-side heat exchanger (40) is changed," the capability of the heat-source-side heat exchanger (40) can be lowered through the switching of the heat-source-side heat exchanger (40) from the large capacity state to the small capacity state performed by the heat exchanger control section (84). As a result, the refrigeration cycle can be continuously performed. Thus, according to this embodiment, a "temperature range of the heat source water within which the air conditioner (10) can continuously operate irrespective of its cooling load" can be further broadened than before.

Further, the heat exchanger control section (84) of the controller (70) of this embodiment closes the gas valve (49) and the water valve (50) if the heat-source-side heat exchanger (40) needs to be switched to the small capacity state during the cooling operation, and closes the liquid valve (48) and the water valve (50) if the heat-source-side heat exchanger (40) needs to be switched to the small capacity state during the heating operation. Specifically, in the heat-source-side heat exchanger (40) in the small capacity state, not only the refrigerant, but also the heat source water, is blocked from flowing in the second heat exchange section (41*b*). This can further reduce power required for the conveyance of the heat source water than the case where the heat source water is continuously supplied to the second heat exchange section (41*b*) of the heat-source-side heat exchanger (40) in the small capacity state.

First Variation of First Embodiment

Figure 5:
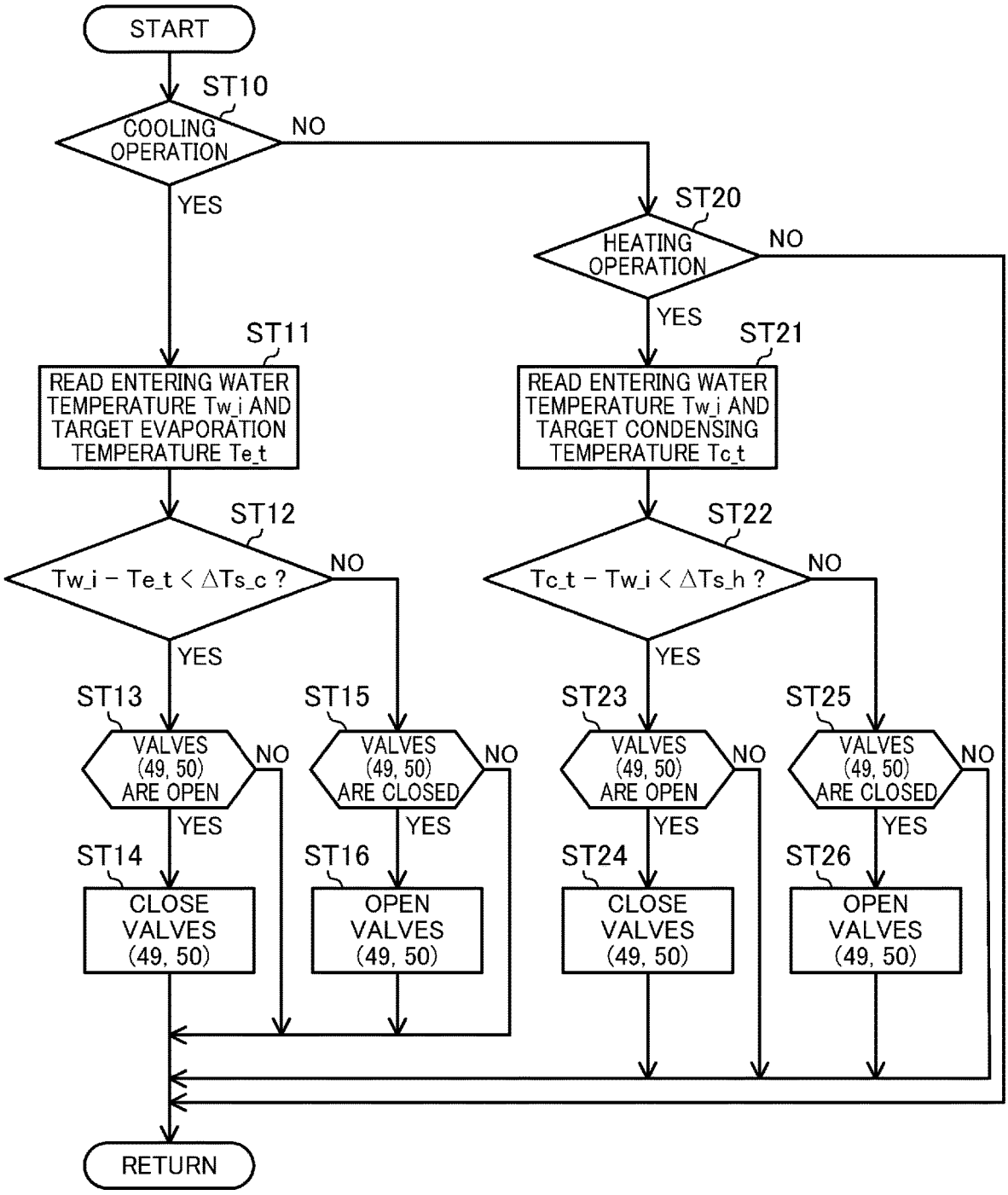
FIG. 5 is a flowchart of control performed by a heat exchanger control section of the controller of the first embodiment.

As can be seen, in the cooling operation of the air conditioner (10), the heat exchanger control section (84) of the controller (70) reduces the heat exchange region of the heat-source-side heat exchanger (40) if Tw_i−Te_t<ΔTs_c is met, and increases the heat exchange region of the heat-source-side heat exchanger (40) if Tw_i−Te_t<ΔTs_c is not met (see Steps ST12 to ST16 in FIG. 5). This control is substantially the same as the control of reducing the heat exchange region of the heat-source-side heat exchanger (40) if Tw_i<Te_t+ΔTs_c is met, and increasing the heat exchange region of the heat-source-side heat exchanger (40) if Tw_i<Te_t+ΔTs_c is not met.

Thus, the heat exchanger control section (84) of this embodiment may reduce the heat exchange region of the heat-source-side heat exchanger (40) if the entering water temperature Tw_i falls below the reference temperature for the cooling operation (Te_t+ΔTs_c). Alternatively, the heat exchanger control section (84) of this embodiment may increase the heat exchange region of the heat-source-side heat exchanger (40) if the entering water temperature Tw_i is equal to or more than the reference temperature for the cooling operation (Te_t+ΔTs_c).

The heat exchanger control section (84) of this variation determines in Step ST12 of FIG. 5 whether the entering water temperature Tw_i falls below the reference temperature for the cooling operation (Te_t+ΔTs_c) or not, i.e., whether Tw_i<Te_t+ΔTs_c is met or not. If Tw_i<Te_t+ΔTs_c is met, the process proceeds to Step ST13 of FIG. 5. If Tw_i<Te_t+ΔTs_c is not met, the process proceeds to Step ST15 of FIG. 5.

As described above, the target evaporation temperature Te_t increases with the decrease, or decreases with the increase, in the cooling load of the air conditioner (10). The reference temperature difference ΔTs_c for the cooling operation is constant. Thus, the heat exchanger control section (84) of both of the first embodiment and the first variation is configured such that the reference temperature for the cooling operation (Te_t+ΔTs_c) increases with the decrease, or decreases with the increase, in the cooling load of the air conditioner (10).

Further, as described above, the target evaporation temperature Te_t increases with the decrease, or decreases with the increase, in the cooling load of the air conditioner (10). Thus, the heat exchanger control section (84) of both of the first embodiment and the first variation is configured such that the reference temperature for the cooling operation (Te_t+ΔTs_c) increases with the decrease, or decreases with the increase, in the cooling load of the air conditioner (10).

Second Variation of First Embodiment

As can be seen, in the heating operation of the air conditioner (10), the heat exchanger control section (84) reduces the heat exchange region of the heat-source-side heat exchanger (40) if Tc_t−Tw_i<ΔTs_h is met, and increases the heat exchange region of the heat-source-side heat exchanger (40) if Tc_t−Tw_i<ΔTs_h is not met (see Steps ST12 to ST16 in FIG. 5). This control is substantially the same as the control of reducing the heat exchange region of the heat-source-side heat exchanger (40) if Tc_t−ΔTs_h<Tw_i is met, and increasing the heat exchange region of the heat-source-side heat exchanger (40) if Tc_t−ΔTs_h<Tw_i is not met.

Thus, the heat exchanger control section (84) of this embodiment may reduce the heat exchange region of the heat-source-side heat exchanger (40) if the entering water temperature Tw_i exceeds the reference temperature for the heating operation (Tc_t−ΔTs_h). Alternatively, the heat exchanger control section (84) of this embodiment may increase the heat exchange region of the heat-source-side heat exchanger (40) if the entering water temperature Tw_i is equal to or less than the reference temperature for the heating operation (Tc_t−ΔTs_h).

The heat exchanger control section (84) of this variation determines in Step ST22 of FIG. 5 whether the entering water temperature Tw_i exceeds the reference temperature for the heating operation (Tc_t−ΔTs_h) or not, i.e., whether Tc_t−ΔTs_h<Tw_i is met or not. If Tc_t−ΔTs_h<Tw_i is met, the process proceeds to Step ST23 of FIG. 5. If Tc_t−ΔTs_h<Tw_i is not met, the process proceeds to Step ST25 of FIG. 5.

As described above, the target condensing temperature Tc_t decreases with the decrease, or increases with the increase, in the heating load of the air conditioner (10). The reference temperature difference ΔTs_h for the cooling operation is constant. Thus, the heat exchanger control section (84) of both of the first embodiment and the second variation is configured such that the reference temperature for the heating operation (Tc_t−ΔTs_h) decreases with the decrease, or increases with the increase, in the heating load of the air conditioner (10).

As described above, the target condensing temperature Tc_t decreases with the decrease, or increases with the increase, in the heating load of the air conditioner (10). Thus, the heat exchanger control section (84) of both of the first embodiment and the second variation is configured such that the reference temperature for the heating operation (Tc_t−ΔTs_h) decreases with the decrease, or increases with the increase, in the heating load of the air conditioner (10).

Third Variation of First Embodiment

The heat exchanger control section (84) of this embodiment may switch the heat-source-side heat exchanger (40) from the small capacity state to the large capacity state if the differential pressure index value is equal to or more than "a value larger than the reference index value." The switching control performed by the heat exchanger control section (84) of this variation will be described below with reference to the flowchart shown in FIG. 6.

Figure 6:
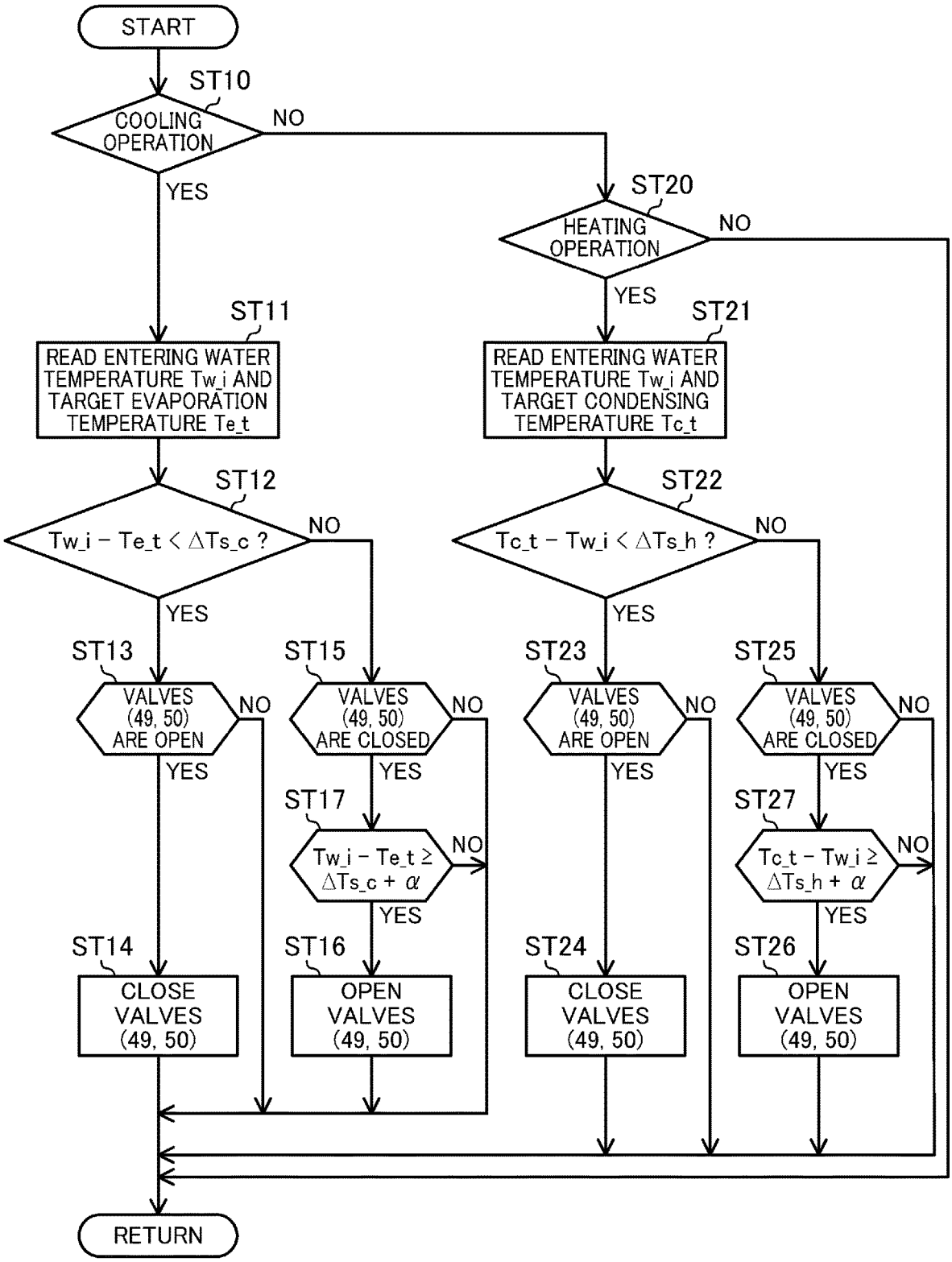
FIG. 6 is a flowchart of control performed by a heat exchanger control section of a controller of a third variation of the first embodiment.

The flowchart of FIG. 6 is a variation of the flowchart of FIG. 5, and additionally includes Steps ST17 and ST27. Thus, the following description will be focused on differences between the control by the heat exchanger control section (84) shown in FIG. 6 and that shown in FIG. 5.

<Control by Heat Exchanger Control Section in Cooling Operation>

When the air conditioner (10) is performing the cooling operation, if the heat exchanger control section (84) of this variation determines in Step ST12 that Tw_i−Te_t<ΔTs_c is not met, and determines in the subsequent Step ST15 that the gas valve (49) and the water valve (50) are closed, the process proceeds to Step ST17. In Step ST17, the heat exchanger control section (84) compares (Tw_i−Te_t) with (ΔTs_c+α). Tw_i denotes the entering water temperature, Te_t the target evaporation temperature, and ΔTs_c the reference temperature for the cooling operation. Further, a denotes a constant stored in advance in the heat exchanger control section (84).

If (Tw_i−Te_t) is equal to or more than (ΔTs_c+α), the process proceeds to Step ST16, and the heat exchanger control section (84) opens the gas valve (49) and the water valve (50). As a result, the heat-source-side heat exchanger (40) is switched from the small capacity state to the large capacity state. If (Tw_i−Te_t) is less than (ΔTs_c+α), the heat exchanger control section (84) keeps the gas valve (49) and the water valve (50) closed. As a result, the heat-source-side heat exchanger (40) is kept in the small capacity state.

As can be seen, if the heat-source-side heat exchanger (40) is in the small capacity state, the heat exchanger control section (84) of this variation keeps the heat-source-side heat exchanger (40) in the small capacity state even if the differential pressure index value (Tw_i−Te_t) is equal to or more than the reference index value ΔTs_c. If (Tw_i−Te_t) is equal to or more than (ΔTs_c+α), the heat exchanger control section (84) switches the heat-source-side heat exchanger (40) from the small capacity state to the large capacity state. This can reduce the possibility of a phenomenon (i.e., hunting) in which the heat-source-side heat exchanger (40) is frequently switched between the small capacity state and the large capacity in a short time.

<Control by Heat Exchanger Control Section in Heating Operation>

When the air conditioner (10) is performing the heating operation, if the heat exchanger control section (84) of this variation determines in Step ST22 that Tc_t−Tw_i<ΔTs_h is not met, and determines in the subsequent Step ST25 that the gas valve (49) and the water valve (50) are closed, the process proceeds to Step ST27. In Step ST27, the heat exchanger control section (84) compares (Tc_t−Tw_i) with (ΔTs_h+α). Tw_i denotes the entering water temperature, Tc_t the target condensing temperature, and ΔTs_h the reference temperature for the heating operation. Further, a denotes a constant stored in advance in the heat exchanger control section (84).

If (Tc_t−Tw_i) is equal to or more than (ΔTs_h+α), the process proceeds to Step ST26, and the heat exchanger control section (84) opens the gas valve (49) and the water valve (50). As a result, the heat-source-side heat exchanger (40) is switched from the small capacity state to the large capacity state. If (Tc_t−Tw_i) is less than (ΔTs_h+α), the heat exchanger control section (84) keeps the gas valve (49) and the water valve (50) closed. As a result, the heat-source-side heat exchanger (40) is kept in the small capacity state.

As can be seen, when the heat-source-side heat exchanger (40) is in the small capacity state, the heat exchanger control section (84) of this variation keeps the heat-source-side heat exchanger (40) in the small capacity state even if the differential pressure index value (Tc_t−Tw_i) is equal to or more than the reference index value ΔTs_h, and switches the heat-source-side heat exchanger (40) from the small capacity state to the large capacity state if the differential pressure index value (Tc_t−Tw_i) is equal to or more than (ΔTs_h+α). This can reduce the possibility of a phenomenon (i.e., hunting) in which the heat-source-side heat exchanger (40) is frequently switched between the small capacity state and the large capacity in a short time.

Fourth Variation of First Embodiment

In this embodiment, the heat exchanger control section (84) sets the reference index values (specifically, the reference temperature difference ΔTs_c for the cooling operation the reference temperature difference ΔTs_h for the heating operation) to be constant values. Alternatively, the heat exchanger control section (84) may change the reference index values depending on the operating state of the air conditioner (10).

For example, the heat exchanger control section (84) may change the reference temperature difference ΔTs_c for the cooling operation, and the reference temperature difference ΔTs_h for the heating operation depending on the entering water temperature Tw_i. Alternatively, the heat exchanger control section (84) may change the reference temperature difference ΔTs_c for the cooling operation depending on the entering water temperature Tw the evaporation temperature of the refrigerant in the indoor unit (12), and the flow rate of the refrigerant circulating in the refrigerant circuit (15), and may also change the reference temperature difference ΔTs_h for the heating operation depending on the entering water temperature Tw_i, the condensing temperature of the refrigerant in the indoor unit (12), and the flow rate of the refrigerant circulating in the refrigerant circuit (15).

Second Embodiment

A second embodiment will be described. An air conditioner (10) of this embodiment is a modified version, of the air conditioner (10) of the first embodiment, in which the heat exchanger control section (84) of the controller (70) has been modified. Thus, the following description will be focused on the differences between the air conditioner (10) of this embodiment and the air conditioner (10) of the first embodiment.

—Control by Heat Exchanger Control Section (Cooling Operation)—

The control performed by the heat exchanger control section (84) while the air conditioner (10) is performing the cooling operation will be described below with reference to the flowchart shown in FIG. 7.

In the cooling operation of the air conditioner (10), the heat exchanger control section (84) uses a difference (Tc_hs−Te_t) between a condensing temperature Tc_hs of the refrigerant in the heat source unit (11) and the target evaporation temperature Te_t as a differential pressure index value, and adjusts the size of the heat exchange region of the heat-source-side heat exchanger (40) so that the differential pressure index value becomes equal to or more than a reference temperature difference ΔTs_c, which is a reference index value.

In Step ST31, the heat exchanger control section (84) reads the measurement of the high pressure sensor (91) (i.e., high pressure HP of the refrigeration cycle performed in the refrigerant circuit (15)) and the target evaporation temperature Te_t determined by the target evaporation temperature setting section (81). Further, also in Step ST31, the heat exchanger control section (84) calculates a saturation pressure of the refrigeration corresponding to the high pressure HP of the refrigeration cycle (i.e., a temperature at which the saturation pressure of the refrigerant reaches the high pressure HP), and determines the calculated value to be a target condensing temperature Tc_hs of the refrigerant in the heat source unit (11).

In the subsequent Step ST32, the heat exchanger control section (84) compares the difference (Tc_hs−Te_t) between the condensing temperature Tc_hs of the refrigerant in the heat source unit (11) and the target evaporation temperature Te_t with the reference temperature difference ΔTs_c for the cooling operation. Note that the value of the reference temperature difference ΔTs_c in this embodiment differs from that in the first embodiment.

In Step ST32, if the value (Tc_hs−Te_t) is less than ΔTs_c (i.e., (Tc_hs−Te_t)<ΔTs_c is met), the differential pressure index value (Tc_hs−Te_t) is small, which may reduce the difference between the high pressure and low pressure of the refrigeration cycle too much. Therefore, in such a case, it is desired that the capability of the heat-source-side heat exchanger (40) is lowered. In this case, the process proceeds to step ST33, and the heat exchanger control section (84) determines whether the gas valve (49) and the water valve (50) are open or not.

If the gas valve (49) and the water valve (50) are open, the heat-source-side heat exchanger (40) is in the large capacity state in which both of the first and second heat exchange sections (41*a*) and (41*b*) function as condensers. Therefore, in such a case, the capability of the heat-source-side heat exchanger (40) can be lowered.

Thus, if it is determined in step ST33 that the gas valve (49) and the water valve (50) are open, the process proceeds to step ST34, and the heat exchanger control section (84) closes the gas valve (49) and the water valve (50). Once the gas valve (49) and the water valve (50) are closed, the heat-source-side heat exchanger (40) is switched to the small capacity state in which only the first heat exchange section (41*a*) functions as a condenser and the second heat exchange section (41*b*) rests.

If the gas valve (49) and the water valve (50) are closed, the capability of the heat-source-side heat exchanger (40) cannot be lowered because the heat-source-side heat exchanger (40) is already in the small capacity state. Thus, in this case, the heat exchanger (84) finishes the control.

If the value (Tc_hs−Te_t) is equal to or more than ΔTs_c (i.e., Tc_hs−Te_t<ΔTs_c is not met) in Step ST32, the differential pressure index value (Tc_hs−Te_t) is large, the difference between the high pressure and low pressure of the refrigeration cycle may become too large, which may increase the power consumption of the compressor (21). Therefore, in such a case, it is desired that the capability of the heat-source-side heat exchanger (40) is increased. In this case, the process proceeds to step ST35, and the heat exchanger control section (84) determines whether the gas valve (49) and the water valve (50) are closed or not.

If the gas valve (49) and the water valve (50) are closed, the heat-source-side heat exchanger (40) is in the small capacity state in which only the first heat exchange section (41*a*) functions as a condenser and the second heat exchange section (41*b*) rests. Therefore, in such a case, the capability of the heat-source-side heat exchanger (40) can be increased.

However, if the heat-source-side heat exchanger (40) is immediately switched from the small capacity state to the large capacity state, the condensing temperature Tc_hs of the refrigerant in the heat-source-side heat exchanger (40) is lowered, and the value (Tc_hs−Te_t) may possibly fall below ΔTs_c. If so, the heat-source-side heat exchanger (40) is switched again from the large capacity state to the small capacity state. As a result, the hunting may possibly occur, i.e., the heat-source-side heat exchanger (40) is frequently switched between the small capacity state and the large capacity in a short time.

Then, the process proceeds to Step ST37. In Step ST37, the heat exchanger control section (84) calculates an estimated value Tc_hs' of the condensing temperature of the refrigerant in the heat-source-side heat exchanger (40) on the assumption that the heat-source-side heat exchanger (40) has been switched from the small capacity state to the large capacity state.

Specifically, the heat-source-side heat exchanger (84) calculates a heat exchange quantity Q between the heat source water and the refrigerant in the heat-source-side heat exchanger (40) based on the entering water temperature Tw_i, which is the measurement of the entering water temperature sensor (96), the exit water temperature Tw_o, which is the measurement of the exit water temperature sensor (97), and the flow rate of the heat source water supplied to the heat-source-side heat exchanger (40). Further, the heat exchanger control section (84) also calculates, based on a previously stored characteristic formula of the heat-source-side heat exchanger (40), an overall heat transfer coefficient K and heat transfer area A of the heat-source-side heat exchanger (40) on the assumption that the heat-source-side heat exchanger (40) has been switched from the small capacity state to the large capacity state.

Based on the heat exchange quantity Q, the overall heat transfer coefficient K, the heat transfer area A, and the entering water temperature Tw_i, the heat exchanger control section (84) calculates an estimated value Tw_o' of the exit water temperature on the assumption that the heat-source-side heat exchanger (40) has been switched from the small capacity state to the large capacity state. The condensing temperature of the refrigerant in the heat-source-side heat exchanger (40) is generally higher than the exit water temperature by a certain value. Thus, the heat exchanger control section (84) determines a value obtained by adding a previously stored constant to the estimated value Tw_o' of the exit water temperature to be the estimated value Tc_hs' of the condensing temperature of the refrigerant in the heat-source-side heat exchanger (40).

In the subsequent step ST38, the heat exchanger control section (84) compares the difference (Tc_hs'−Te_t) between the estimated value Tc_hs' of the condensing temperature calculated in Step ST37 and the target evaporation temperature Te_t with the reference temperature difference ΔTs_c for the cooling operation.

If the value (Tc_hs'−Te_t) is equal to or more than ΔTs_c, the value (Tc_hs−Te_t) is probably kept equal to or more than ΔTs_c even after the switching of the heat-source-side heat exchanger (40) from the small capacity state to the large capacity state. If (Tc_hs'−Te_t)≥ΔTs_c is met in Step ST38, the process proceeds to step ST36, and the heat exchanger control section (84) opens the liquid valve (48) and the water valve (50). Once the liquid valve (48) and the water valve (50) are opened, the heat-source-side heat exchanger (40) is switched to the large capacity state in which both of the first and second heat exchange sections (41*a*) and (41*b*) function as condensers.

If the value (Tc_hs'−Te_t) is less than ΔTs_c, the value (Tc_hs−Te_t) is probably less than ΔTs_c even after the switching of the heat-source-side heat exchanger (40) from the small capacity state to the large capacity state. If (Tc_hs'−Te_t)≥ΔTs_c is not met in Step ST38, the heat exchanger control section (84) keeps the liquid valve (48) and the water valve (50) closed, and finishes the control.

—Control by Heat Exchanger Control Section (Heating Operation)—

The control performed by the heat exchanger control section (84) while the air conditioner (10) is performing the heating operation will be described below with reference to the flowchart shown in FIG. 8.

In the heating operation of the air conditioner (10), the heat exchanger control section (84) uses a difference (Tc_t−Te_hs) between the target condensing temperature Tc_t and the evaporation temperature Te_hs of the refrigerant in the heat source unit (11) as a differential pressure index value, and adjusts the size of the heat exchange region of the heat-source-side heat exchanger (40) so that the differential pressure index value becomes equal to or more than a reference temperature difference ΔTs_h, which is a reference index value.

In step ST41, the heat exchanger control section (84) reads the measurement of the low pressure sensor (92) (i.e., low pressure LP of the refrigeration cycle performed in the refrigerant circuit (15)) and the target condensing temperature Tc_t determined by the target condensing temperature setting section (82). Further, also in step ST41, the heat exchanger control section (84) calculates a saturation temperature of the refrigerant corresponding to the high pressure LP of the refrigeration cycle (i.e., a temperature at which the saturation pressure of the refrigerant reaches the high pressure LP), and determines the calculated value to be an evaporation temperature Te_hs of the refrigerant in the heat source unit (11).

In the subsequent step ST42, the heat exchanger control section (84) compares the difference (Tc_t−Te_hs) between the target condensing temperature Tc_t and the evaporation temperature Te_hs of the refrigerant in the heat source unit (11) with the reference temperature difference ΔTs_h for the heating operation. Note that the value of the reference temperature difference ΔTs_h in this embodiment differs from that in the first embodiment.

In Step ST42, if the value (Tc_t−Te_hs) is less than ΔTs_h (i.e., (Tc_t−Te_hs)<ΔTs_h is met), the differential pressure index value (Tc_t−Te_hs) is small, which may possibly lower the difference between the high pressure and low pressure of the refrigeration cycle too much. Therefore, in such a case, it is desired that the capability of the heat-source-side heat exchanger (40) is lowered. In this case, the process proceeds to step ST43, and the heat exchanger control section (84) determines whether the gas valve (49) and the water valve (50) are open or not.

If the gas valve (49) and the water valve (50) are open, the heat-source-side heat exchanger (40) is in the large capacity state in which both of the first and second heat exchange sections (41*a*) and (41*b*) function as evaporators. Therefore, in such a case, the capability of the heat-source-side heat exchanger (40) can be lowered.

Thus, if it is determined in step ST43 that the gas valve (49) and the water valve (50) are open, the process proceeds to step ST44, and the heat exchanger control section (84) closes the gas valve (49) and the water valve (50). Once the gas valve (49) and the water valve (50) are closed, the heat-source-side heat exchanger (40) is switched to the small capacity state in which only the first heat exchange section (41*a*) functions as an evaporator and the second heat exchange section (41*b*) rests.

If the gas valve (49) and the water valve (50) are closed, the capability of the heat-source-side heat exchanger (40) cannot be lowered because the heat-source-side heat exchanger (40) is already in the small capacity state. Thus, in this case, the heat exchanger (84) finishes the control.

If the value (Tc_t−Te_hs) is equal to or more than ΔTs_h (i.e., (Tc_t−Te_hs)<ΔTs_h is not met) in Step ST42, the differential pressure index value (Tc_t−Te_hs) is large, the difference between the high pressure and low pressure of the refrigeration cycle may become too large, which may increase the power consumption of the compressor (21). Therefore, in such a case, it is desired that the capability of the heat-source-side heat exchanger (40) is increased. In this case, the process proceeds to step ST45, and the heat exchanger control section (84) determines whether the gas valve (49) and the water valve (50) are closed or not.

If the gas valve (49) and the water valve (50) are closed, the heat-source-side heat exchanger (40) is in the small capacity state in which only the first heat exchange section (41*a*) functions as a condenser and the second heat exchange section (41*b*) rests. Therefore, in such a case, the capability of the heat-source-side heat exchanger (40) can be increased.

However, if the heat-source-side heat exchanger (40) is immediately switched from the small capacity state to the large capacity state, the condensing temperature Tc_hs of the refrigerant in the heat-source-side heat exchanger (40) is lowered, and the value (Tc_t−Te_hs) may possibly fall below ΔTs_h. If so, the heat-source-side heat exchanger (40) is switched again from the large capacity state to the small capacity state. As a result, the hunting may possibly occur, i.e., the heat-source-side heat exchanger (40) is frequently switched between the small capacity state and the large capacity in a short time.

Then, the process proceeds to Step ST47. In Step ST47, the heat exchanger control section (84) calculates an estimated value Te_hs' of the evaporation temperature of the refrigerant in the heat-source-side heat exchanger (40) on the assumption that the heat-source-side heat exchanger (40) has been switched from the small capacity state to the large capacity state.

Figure 7:
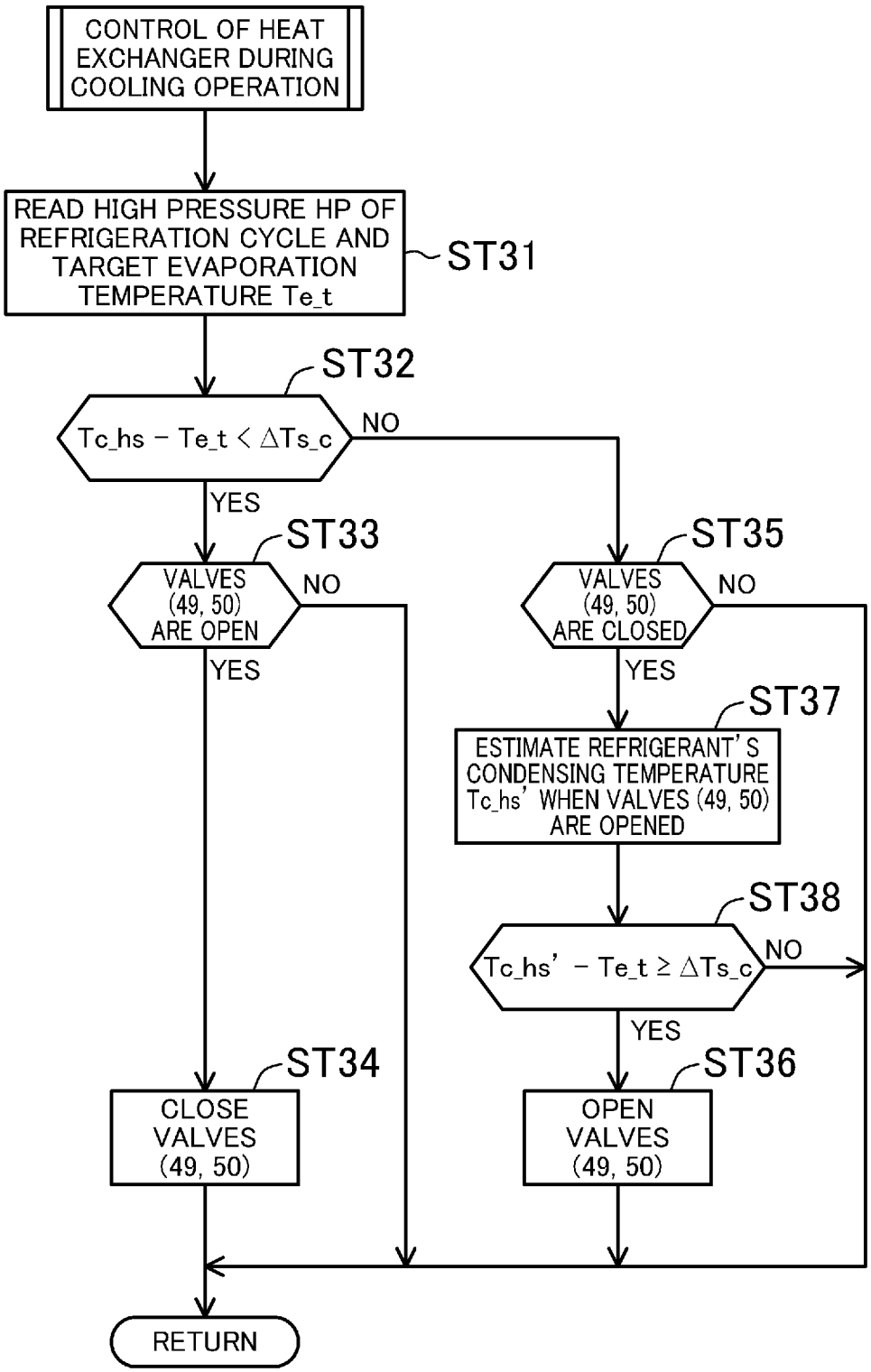
FIG. 7 is a flowchart of control performed during the cooling operation by a heat exchanger control section of a controller of a second embodiment.

In Step ST47, the heat exchanger control section (84) calculates an estimated value Tw_o' of the exit water temperature in the same manner as in Step ST37 shown in FIG. 7 on the assumption that the heat-source-side heat exchanger (40) has been switched from the small capacity state to the large capacity state. The evaporation temperature of the refrigerant in the heat-source-side heat exchanger (40) is generally lower than the exit water temperature Tw_o by a certain value. Thus, the heat exchanger control section (84) determines a value obtained by adding a previously stored constant to the estimated value Tw_o' of the exit water temperature to be an estimated value Te_hs' of the evaporation temperature of the refrigerant in the heat-source-side heat exchanger (40).

In the subsequent step ST48, the heat exchanger control section (84) compares the difference between the estimated value Te_hs' of the evaporation temperature calculated in Step ST47 and the target condensing temperature Tc_t (Tc_t−Te_hs') with the reference temperature difference ΔTs_h for the heating operation.

If the value (Tc_t−Te_hs') is equal to or more than ΔTs_h, the value (Tc_t−Te_hs') is probably kept equal to or more than ΔTs_h even after the switching of the heat-source-side heat exchanger (40) from the small capacity state to the large capacity state. If (Tc_t−Te_hs')≥ΔTs_h is met in Step ST46, the process proceeds to step ST48, and the heat exchanger control section (84) opens the liquid valve (48) and the water valve (50). Once the liquid valve (48) and the water valve (50) are opened, the heat-source-side heat exchanger (40) is switched to the large capacity state in which both of the first and second heat exchange sections (41*a*) and (41*b*) function as evaporators.

If the value (Tc_t−Te_hs') is less than ΔTs_h, the value (Tc_t−Te_hs') is probably less than ΔTs_h when the heat-source-side heat exchanger (40) is switched from the small capacity state to the large capacity state. If (Tc_t−Te_hs') ≥ΔTs_h is not met in Step ST48, the heat exchanger control section (84) keeps the liquid valve (48) and the water valve (50) closed, and finishes the control.

—Differential Pressure Index Value—

As can be seen, in the cooling operation of the air conditioner (10), the heat exchanger control section (84) uses, as the differential pressure index value, the difference (Tc_hs−Te_t) between the condensing temperature Tc_hs of the refrigerant in the heat source unit (11) and the target evaporation temperature Te_t. The condensing temperature Tc_hs of the refrigerant in the indoor unit (11) correlates with the high pressure of the refrigeration cycle, and the target evaporation temperature Te_t correlates with the low pressure of the refrigeration cycle. Thus, the difference (Tc_hs−Te_t) between the condensing temperature Tc_hs of the refrigerant and the target evaporation temperature Te_t increases with the increase, or decreases with the decrease, in the difference between the high pressure and low pressure of the refrigeration cycle. Thus, the value (Tc_hs−Te_t) can be a differential pressure index value indicating the difference between the high pressure and low pressure of the refrigeration cycle performed in the refrigerant circuit (15).

Further, as can be seen, in the heating operation of the air conditioner (10), the heat exchanger control section (84) uses, as the differential pressure index value, the difference (Tc_t−Te_hs) between the target condensing temperature Tc_t and the evaporation temperature Te_hs of the refrigerant in the heat source unit (11). The target condensing temperature Tc_t correlates with the high pressure of the refrigeration cycle, and the evaporation temperature Te_hs of the refrigerant in the heat source unit (11) correlates with the low pressure of the refrigeration cycle. Thus, the difference (Tc_t−Te_hs) between the target condensing temperature Tc_t and the evaporation temperature Te_hs of the refrigerant in the heat source unit (11) increases with the increase, or decreases with the decrease, in the difference between the high pressure and low pressure of the refrigeration cycle. Thus, the value (Tc_t−Te_hs) can be a differential pressure index value indicating the difference between the high pressure and low pressure of the refrigeration cycle performed in the refrigerant circuit (15).

Variation of Second Embodiment

The heat exchanger control section (84) of this embodiment uses, as the differential pressure index value for the cooling operation, "the difference (Tc_hs−Te_t) between the condensing temperature Tc_hs of the refrigerant in the heat source unit (11) and the target evaporation temperature Te_t." Alternatively, the "difference (Tw_o−Te_t) between the exit water temperature Tw_o, which is the measurement of the exit water temperature sensor (97), and the target evaporation temperature Te_t" may be used as the differential pressure index value.

In the control during the cooling operation shown in FIG. 7, the heat exchanger control section (84) of this variation determines in Step ST32 whether Tw_o−Te_t<ΔTs_c is met or not. Note that the value of the reference temperature difference ΔTs_c in this variation differs from that in the case where the value (Tc_hs−Te_t) is used as the differential pressure index value. Further, in Step ST37, the heat exchanger control section (84) of this variation calculates "an estimated value Tw_o' of the exit water temperature on the assumption that the heat-source-side heat exchanger (40) has been switched from the small capacity state to the large capacity state," and determines whether Tw_o'−Te_t≥ΔTs_c is met or not.

The condensing temperature of the refrigerant in the heat-source-side heat exchanger (40) is generally higher than the exit water temperature Tw_o by a certain value. Further, the condensing temperature of the refrigerant in the heat-source-side heat exchanger (40) correlates with the high pressure of the refrigeration cycle, and the target evaporation temperature Te_t correlates with the low pressure of the refrigeration cycle. Thus, the difference (Tw_o−Te_t) between the exit water temperature Tw_o and the target evaporation temperature Te_t increases with the increase, or decreases with the decrease, in the difference between the high pressure and low pressure of the refrigeration cycle. Thus, the value (Tw_o−Te_t) can be a differential pressure index value indicating the difference between the high pressure and low pressure of the refrigeration cycle performed in the refrigerant circuit (15).

The heat exchanger control section (84) of this variation uses, as the differential pressure index value for the heating operation, "the difference (Tc_t−Te_hs) between the target condensing temperature Tc_t and the evaporation temperature Te_hs of the refrigerant in the heat source unit (11)." Alternatively, the "difference (Tc_t−Tw_o) between the target condensing temperature Tc_t and the exit water temperature Tw_o, which is the measurement of the exit water temperature sensor (97)" may be used as the differential pressure index value for the heating operation.

Figure 8:
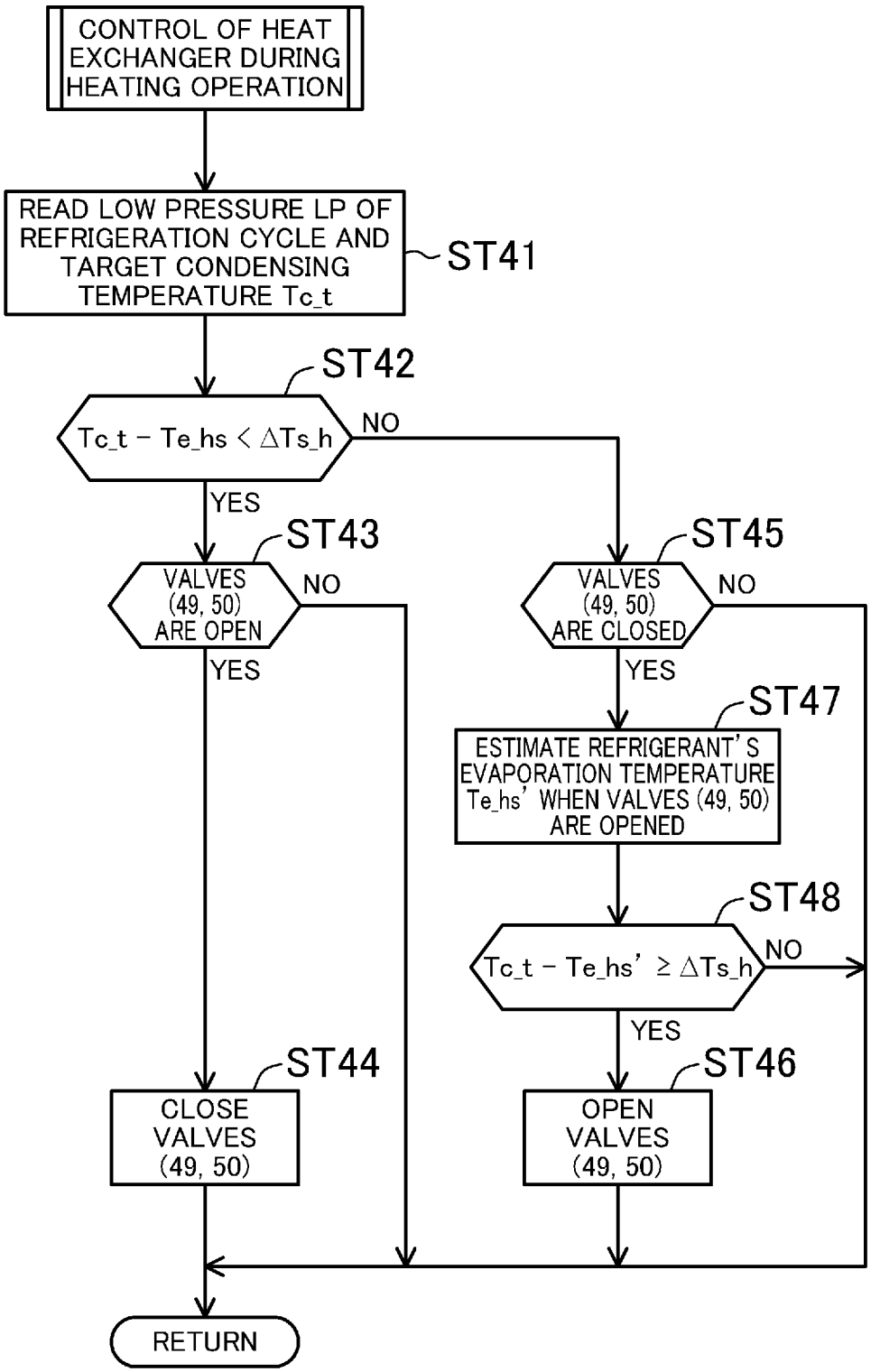
FIG. 8 is a flowchart of control performed during a heating operation by the heat exchanger control section of the controller of the second embodiment.

In the control during the heating operation shown in FIG. 8, the heat exchanger control section (84) of this variation determines in Step ST42 whether Tc_t−Tw_o<ΔTs_h is met or not. Note that the value of the reference temperature difference ΔTs_h in this variation differs from that in the case where (Tc_t−Te_hs) is used as the differential pressure index value. Further, in Step ST47, the heat exchanger control section (84) of this variation calculates "an estimated value Tw_o' of the exit water temperature on the assumption that the heat-source-side heat exchanger (40) has been switched from the small capacity state to the large capacity state," and determines in step ST48 whether (Tc_t−Tw_o'≥ΔTs_h is met or not.

The evaporation temperature of the refrigerant in the heat-source-side heat exchanger (40) is generally lower than the exit water temperature Tw_o by a certain value. Further, the target condensing temperature Tc_t correlates with the high pressure of the refrigeration cycle, and the evaporation temperature of the refrigerant in the heat-source-side heat exchanger (40) correlates with the low pressure of the refrigeration cycle. Thus, the difference (Tc_t−Tw_o) between the target condensing temperature Tc_t and the exit water temperature Tw_o increases with the increase, or decreases with the decrease, in the difference between the high pressure and low pressure of the refrigeration cycle. Therefore, the value (Tc_t−Tw_o) can be a differential pressure index value indicating the difference between the high pressure and low pressure of the refrigeration cycle performed in the refrigerant circuit (15).

Third Embodiment

A third embodiment will be described. An air conditioner (10) of this embodiment is a modified version, of the air conditioner (10) of the first embodiment, in which the heat-source-side heat exchanger (40) of the heat source unit (11) has been modified. Thus, the following description will be focused on the differences between the air conditioner (10) of this embodiment and the air conditioner (10) of the first embodiment.

<Heat-Source-Side Heat Exchanger>

Figure 9:
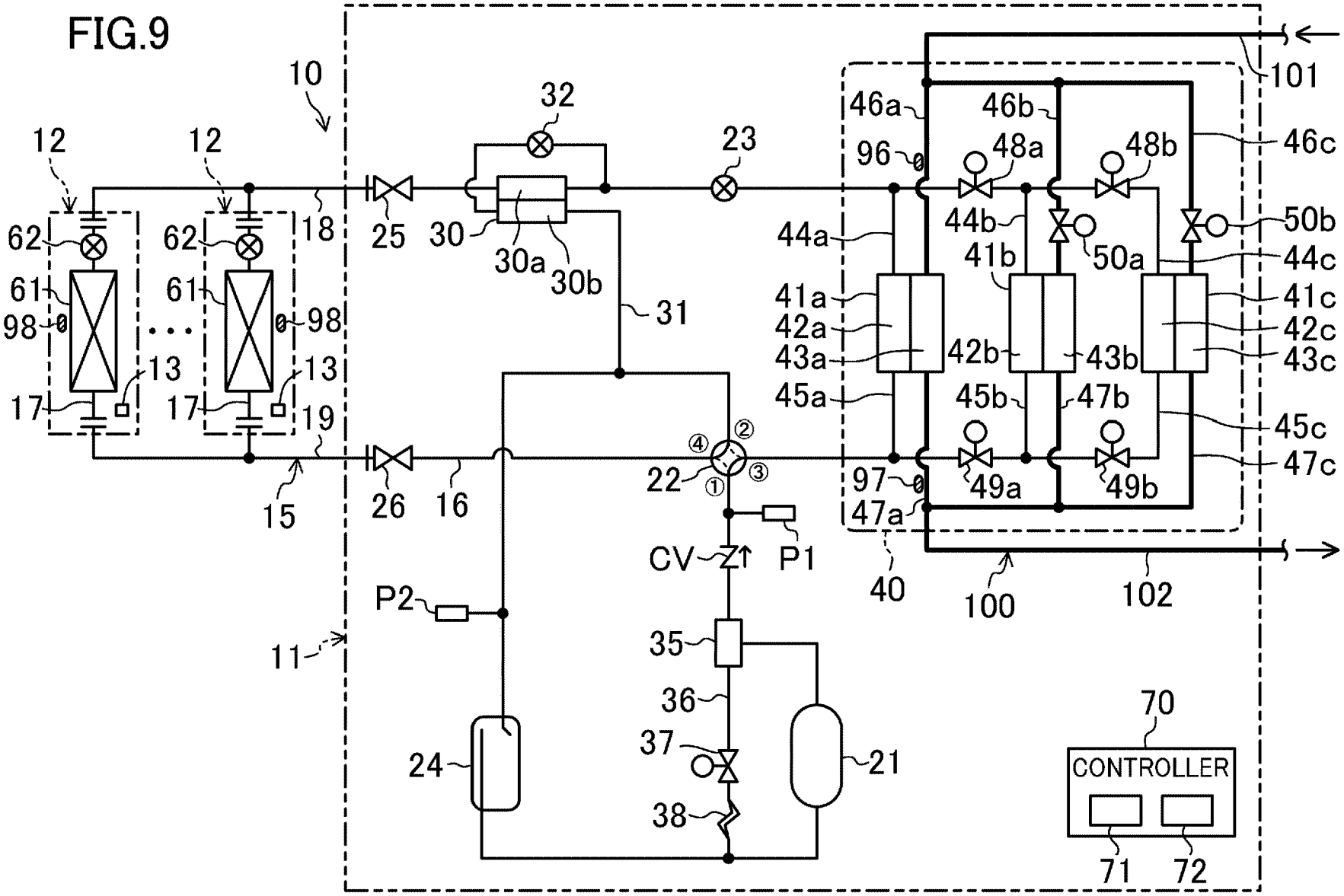
FIG. 9 is a refrigerant circuit diagram illustrating a configuration of an air conditioner according to a third embodiment.

As shown in FIG. 9, the heat-source-side heat exchanger (40) of this embodiment includes three heat exchange sections (41*a*, 41*b*, 41*c*), three liquid passages (44*a*, 44*b*, 44*c*), three gas passages (45*a*, 45*b*, 45*c*), three water introduction channels (46*a*, 46*b*, 46*c*), and three water delivery channels (47*a*, 47*b*, 47*c*). The heat exchange sections (41*a*, 41*b*, 41*c*) are configured in the same manner as the heat exchange sections (41*a*, 41*b*) of the first embodiment.

The refrigerant channels (42*a*, 42*b*, 42*c*) of the heat exchange sections (41*a*, 41*b*, 41*c*) are connected in parallel. Specifically, an end of the refrigerant passage (42*a*) of the first heat exchange section (41*a*) is connected to an end of the first liquid passage (44*a*). An end of the refrigerant passage (42*b*) of the second heat exchange section (41*b*) is connected to an end of the second liquid passage (44*b*). An end of the refrigerant passage (42*c*) of the third heat exchange section (41*c*) is connected to an end of the third liquid passage (44*c*). The other end of the first liquid passage (44*a*), the other end of the second liquid passage (44*b*), and the other end of the third liquid passage (44*c*) constitute a liquid end of the heat-source-side heat exchanger (40), which is connected to a pipe connecting the heat-source-side heat exchanger (40) and the heat-source-side expansion valve (23). The other end of the refrigerant passage (42*a*) of the first heat exchange section (41*a*) is connected to the other end of the first gas passage (45*a*). The other end of the refrigerant passage (42*b*) of the second heat exchange section (41*b*) is connected to the other end of the second gas passage (45*b*). The other end of the refrigerant passage (42*c*) of the third heat exchange section (41*c*) is connected to the other end of the third gas passage (45*c*). The other end of the first gas passage (45*a*), the other end of the second gas passage (45*b*), and the other end of the third gas passage (45*c*) constitute a gas end of the heat-source-side heat exchanger (40), which is connected to a pipe connecting the heat-source-side heat exchanger (40) and the third port of the four-way switching valve (22).

The second liquid passage (44*b*) is provided with a liquid valve (48*a*), and the third liquid passage (44*c*) is provided with a liquid valve (48*b*). The second gas passage (45*b*) is provided with a gas valve (49*a*), and the third gas passage (45*c*) is provided with a gas valve (49*b*). The two liquid valves (48*a*, 48*b*) and the two gas valves (49*a*, 49*b*) are solenoid valves, and constitute a refrigerant valve mechanism for changing the number of heat exchange sections (41*a*, 41*b*, 41*c*) into which the refrigerant flows.

The heat source water channels (43*a*, 43*b*, 43*c*) of the heat exchange sections (41*a*, 41*b*, 41*c*) are connected in parallel. Specifically, an end of the heat source water channel (43*a*) of the first heat exchange section (41*a*) is connected to an end of the first water introduction channel (46*a*). An end of the heat source water channel (43*b*) of the second heat exchange section (41*b*) is connected to an end of the second water introduction channel (46*b*). An end of the heat source water channel (43*c*) of the third heat exchange section (41*c*) is connected to an end of the third water introduction channel (46*c*). The other end of the first water introduction channel (46*a*), the other end of the second water introduction channel (46*b*), and the other end of the third water introduction channel (46*c*) are connected to a flow-in pipe (101) of a heat source water circuit (100). The other end of the heat source water channel (43*a*) of the first heat exchange section (41*a*) is connected to an end of the first water delivery channel (47*a*). The other end of the heat source water channel (43*b*) of the second heat exchange section (41*b*) is connected to an end of the second water delivery channel (47*b*). The other end of the heat source water channel (43*c*) of the third heat exchange section (41*c*) is connected to an end of the third water delivery channel (47*c*). The other end of the first water delivery channel (47*a*), the other end of the second water delivery channel (47*b*), and the other end of the third water delivery channel (47*c*) are connected to a flow-out pipe (102) of the heat source water circuit (100).

The second water introduction channel (46*b*) is provided with a water valve (50*a*), and the third water introduction channel (46*c*) is provided with a water valve (50*b*). The two water valves (50*a*, 50*b*) constitute a water valve mechanism for changing the number of heat exchange sections (41*a*, 41*b*, 41*c*) into which the heat source water flows. Just like in the first embodiment, the first water introduction channel (46*a*) is provided with an entering water temperature sensor (96) which measures the temperature of the heat source water, and the first water delivery channel (47*a*) is provided with an exit water temperature sensor (97) which measures the temperature of the heat source water.

The heat-source-side heat exchanger (40) can be switched among a large capacity state in which the refrigerant and the heat source water flow through all the first to third heat exchange sections (41*a*, 41*b*, 41*c*), a medium capacity state in which the refrigerant and the heat source water flow only through the first and second heat exchange sections (41*a*) and (41*b*), and a small capacity state in which the refrigerant and the heat source water flow only through the first heat exchange section (41*a*). Switching among the large capacity state, the medium capacity state, and the small capacity state is performed through operation of the liquid valves (48*a*, 48*b*), the gas valves (49*a*, 49*b*), and the water valves (50*a*, 50*b*).

In the large capacity state, all the first to third heat exchange sections (41*a*, 41*b*, 41*c*) function as heat exchange regions in each of which the refrigerant exchanges heat with the heat source water. In the medium capacity state, only the first and second heat exchange sections (41*a*) and (41*b*) function as heat exchange regions in each of which the refrigerant exchanges heat with the heat source water. In the small capacity state, only the first heat exchange section (41*a*) functions as a heat exchange region in which the refrigerant exchanges heat with the heat source water. Thus, the heat-source-side heat exchanger (40) is able to change the size of the heat exchange region.

<Heat Exchanger Control Section>

Just like in the first embodiment, the heat exchanger control section (84) adjusts the size of the heat exchange region of the heat-source-side heat exchanger (40) based on the measurement of the entering water temperature sensor (96). As described above, the heat-source-side heat exchanger (40) of this embodiment includes three heat exchange sections (41*a*, 41*b*, 41*c*). The heat exchanger control section (84) of this embodiment switches the heat-source-side heat exchanger (40) among the large capacity state in which all the first to third heat exchange sections (41*a*, 41*b*, 41*c*) function as condensers or evaporators, the medium capacity state in which the first and second heat exchange sections (41*a*) and (41*b*) function as condensers or evaporators, and the small capacity state in which only the first heat exchange section (41*a*) functions as a condenser or an evaporator and the second and third heat exchange sections (41*b*) and (41*c*) rest.

During the cooling operation of the air conditioner (10), the heat exchanger control section (84) of this embodiment uses, in the same manner as that of the first embodiment, a difference (Tw_i−Te_t) between an entering water temperature Tw_i and the target evaporation temperature Te_t as a differential pressure index value, and compares the differential pressure index value with a reference temperature difference ΔTs_c for the cooling operation. Then, depending on whether Tw_i−Te_t<ΔTs_c is met or not, the heat exchanger control section (84) adjusts the size of the heat exchange region of the heat-source-side heat exchanger (40).

For example, if Tw_i−Te_t<ΔTs_c is met when the heat-source-side heat exchanger (40) is in the large capacity state, the heat exchanger control section (84) switches the heat-source-side heat exchanger (40) from the large capacity state to the medium capacity state. If Tw_i−Te_t<ΔTs_c is met when the heat-source-side heat exchanger (40) is in the medium capacity state, the heat exchanger control section (84) switches the heat-source-side heat exchanger (40) from the medium capacity state to the small capacity state.

If Tw_i−Te_t<ΔTs_c is not met when the heat-source-side heat exchanger (40) is in the small capacity state, the heat exchanger control section (84) switches the heat-source-side heat exchanger (40) from the small capacity state to the medium capacity state. If Tw_i−Te_t<ΔTs_c is not met when the heat-source-side heat exchanger (40) is in the medium capacity state, the heat exchanger control section (84) switches the heat-source-side heat exchanger (40) from the medium capacity state to the large capacity state.

As described above, the target evaporation temperature Te_t increases with the decrease, or decreases with the increase, in the cooling load of the air conditioner (10). The temperature of the heat source water supplied to the heat-source-side heat exchanger (40) is generally constant. Thus, the value (Tw_i−Te_t) decreases with the decrease, or increases with the increase, in the cooling load of the air conditioner (10). Thus, during the cooling operation of the air conditioner (10), the heat exchanger control section (84) of this embodiment operates the liquid valves (48*a*, 48*b*), the gas valves (49*a*, 49*b*), and the water valves (50*a*, 50*b*) so that the size of the heat exchange region of the heat-source-side heat exchanger (40) decreases with the decrease, or increases with the increase, in the cooling load of the air conditioner (10).

During the heating operation of the air conditioner (10), the heat exchanger control section (84) of this embodiment uses, in the same manner as that of the first embodiment, a difference (Tc_t−Tw_i) between the target condensing temperature Tc_t and the entering water temperature Tw_i as a differential pressure index value, and compares the differential pressure index value with a reference temperature difference ΔTs_h for the heating operation. Then, depending on whether Tc_t−Tw_i<ΔTs_h is met or not, the heat exchanger control section (84) adjusts the size of the heat exchange region of the heat-source-side heat exchanger (40).

For example, if Tc_t−Tw_i<ΔTs_h is met when the heat-source-side heat exchanger (40) is in the large capacity state, the heat exchanger control section (84) switches the heat-source-side heat exchanger (40) from the large capacity state to the medium capacity state. If Tc_t−Tw_i<ΔTs_h is met when the heat-source-side heat exchanger (40) is in the medium capacity state, the heat exchanger control section (84) switches the heat-source-side heat exchanger (40) from the medium capacity state to the small capacity state.

If Tc_t−Tw_i<ΔTs_h is not met when the heat-source-side heat exchanger (40) is in the small capacity state, the heat exchanger control section (84) switches the heat-source-side heat exchanger (40) from the small capacity state to the medium capacity state. If Tc_t−Tw_i<ΔTs_h is not met when the heat-source-side heat exchanger (40) is in the medium capacity state, the heat exchanger control section (84) switches the heat-source-side heat exchanger (40) from the medium capacity state to the large capacity state.

As described above, the target condensing temperature Tc_t decreases with the decrease, or increases with the increase, in the heating load of the air conditioner (10). The temperature of the heat source water supplied to the heat-source-side heat exchanger (40) is generally constant. Thus, the value (Tc_t−Tw_i) decreases with the decrease, or increases with the increase, in the heating load of the air conditioner (10). Thus, during the heating operation of the air conditioner (10), the heat exchanger control section (84) of this embodiment operates the liquid valves (48*a*, 48*b*), the gas valves (49*a*, 49*b*), and the water valves (50*a*, 50*b*) so that the size of the heat exchange region of the heat-source-side heat exchanger (40) decreases with the decrease, or increases with the increase, in the heating load of the air conditioner (10).

Variation of Third Embodiment

The heat-source-side heat exchanger (40) of this variation includes four or more heat exchange sections (41*a*, 41*b*, . . . ), four or more liquid passages (44*a*, 44*b*, . . . ), four or more gas passages (45*a*, 45*b*, . . . ), four or more water introduction channels (46*a*, 46*b*, . . . ), and four or more water delivery channels (47*a*, 47*b*, . . . ).

The air conditioner (10) of this variation is a modified version, of the air conditioner (10) of the first embodiment, in which the heat-source-side heat exchanger (40) of the heat source unit (11) has been modified. Alternatively, the heat-source-side heat exchanger (40) of this variation may be provided for the heat source unit (11) of the air conditioner (10) of the second embodiment.

Fourth Embodiment

A fourth embodiment will be described. This embodiment is directed to an air-conditioning system (1) including two or more air conditioners (10) of the first, second, or third embodiment.

Figure 10:
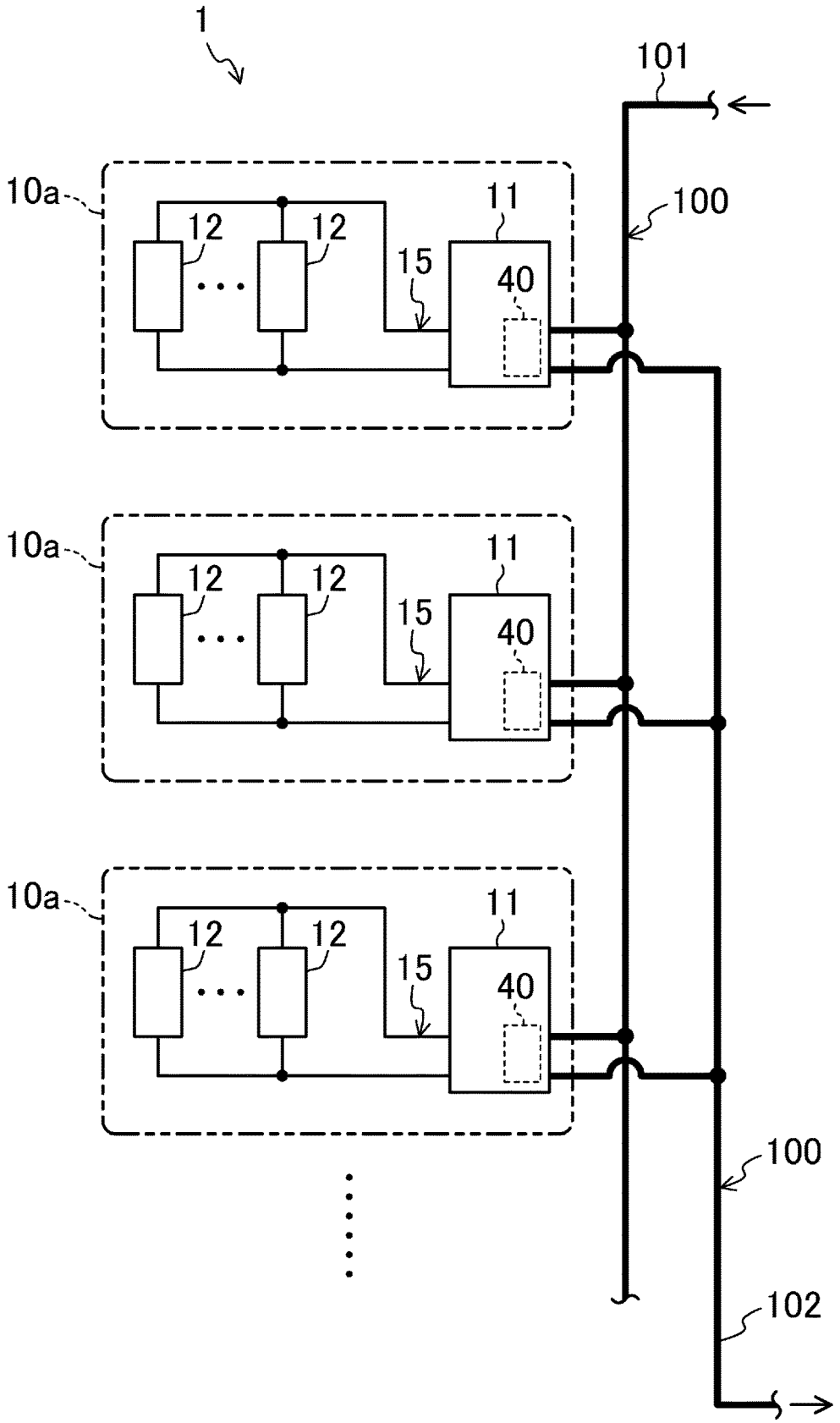
FIG. 10 is a piping diagram illustrating a configuration of an air conditioning system according to a fourth embodiment.

As shown in FIG. 10, the air-conditioning system (1) of this embodiment includes two or more air conditioners (10*a*, 10*b*, 10*c*) and a heat source water circuit (100). In the heat source water circuit (100), the heat source units (11) of the air conditioners (10*a*, 10*b*, 10*c*) are connected together in parallel. Specifically, a flow-in pipe (101) of the heat source water circuit (100) is connected to the water introduction channels (46*a*, 46*b*, 46*c*) of each of the heat-source-side heat exchangers (40) of the heat source units (11), and a flow-out pipe (102) of the heat source water circuit (100) is connected to the water delivery channels (47*a*, 47*b*, 47*c*) of each of the heat-source-side heat exchangers (40) of the heat source units (11). The heat source water circuit (100) supplies the heat source water of the same temperature to the heat-source-side heat exchangers (40) of the heat source units (11).

As described in the first to third embodiments, in each of the air conditioners (10*a*, 10*b*, 10*c*), the heat-source-side heat exchanger (40) has the heat exchange region of a variable size, and the controller (70) of the heat source unit (11) includes the heat exchanger control section (84).

In the air-conditioning system (1) of this embodiment, air conditioning loads (cooling or heating load) of the air conditioners (10*a*, 10*b*, 10*c*) are not always the same, but are generally different from each other. On the other hand, every air conditioner (10*a*, 10*b*, 10*c*) receives the heat source water of the same temperature from the heat source water circuit (100). Thus, if the air conditioning load of the air conditioner (10*a*, 10*b*, 10*c*) is small, the capability of the heat-source-side heat exchanger (40) may become excessive, the air conditioner (10*a*, 10*b*, 10*c*) may become hard to continue operating.

In contrast, in each of the air conditioners (10*a*, 10*b*, 10*c*) of this embodiment, the heat exchanger control section (84) of the controller (70) adjusts the size of the heat exchange region of the heat-source-side heat exchanger (40) based on the measurement of the entering water temperature sensor (96), i.e., the temperature of the heat source water supplied from the flow-in pipe (101) to the heat-source-side heat exchanger (40), or a predetermined differential pressure index value. Thus, even if a certain air conditioner (10*c*) has a greatly smaller air-conditioning load than the other air conditioners (10*a*, 10*b*), the air conditioner (10*c*) can continue operating if the heat-source-side heat exchanger (40) of the air conditioner (10*c*) is switched to the small capacity state.

Therefore, according to this embodiment, even if the air conditioners (10*a*, 10*b*, 10*c*) have the air-conditioning loads which are greatly different from each other, every air conditioner (10*a*, 10*b*, 10*c*) can continue operating without the need to control the temperature of the heat source water supplied from the heat source water circuit (100) to the air conditioners (10*a*, 10*b*, 10*c*).

Other Embodiments

The air conditioner (10) of the first to fourth embodiments can be modified as follows.

First Variation

Figure 11:
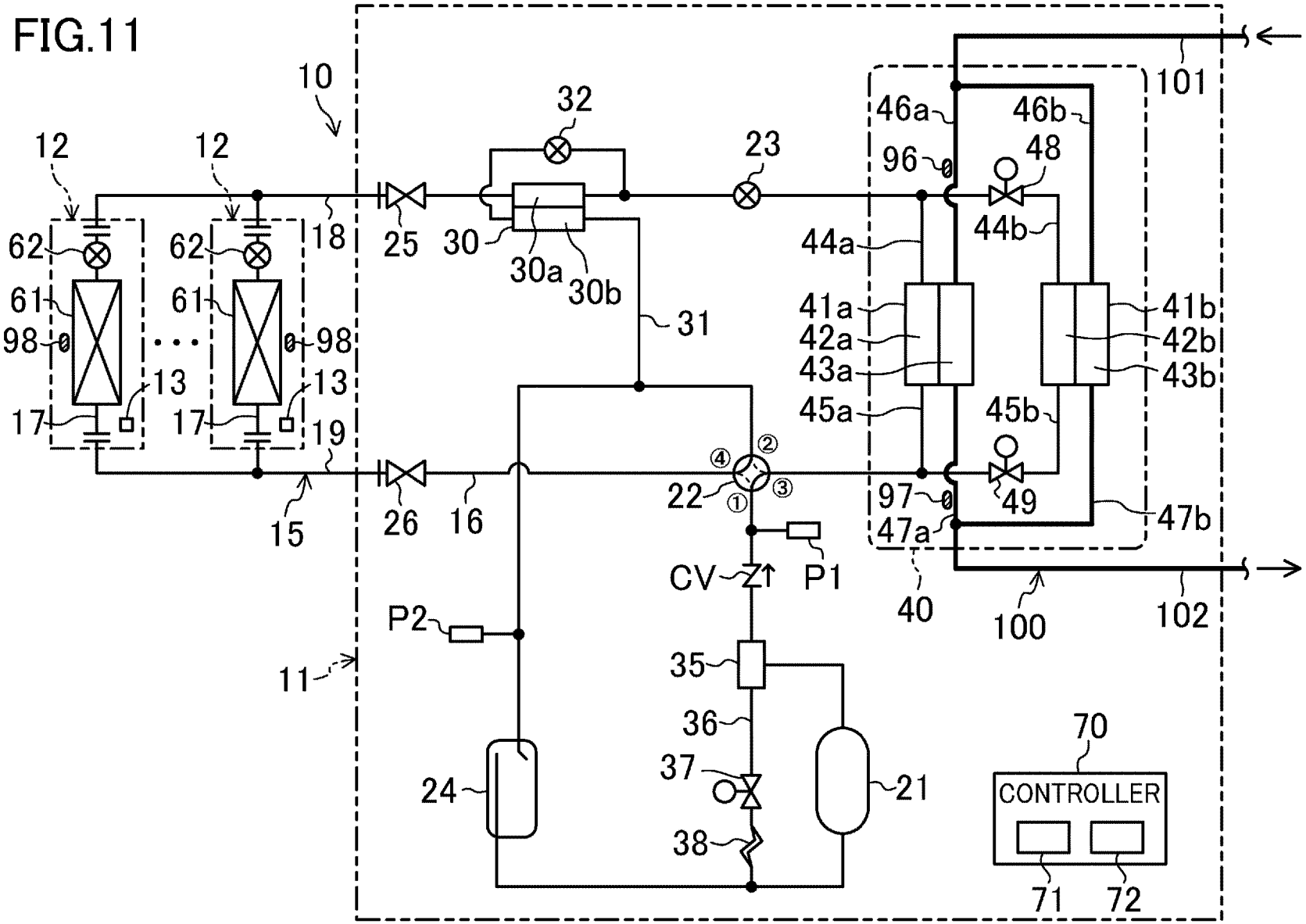
FIG. 11 is a piping diagram illustrating a configuration of an air conditioning system according to a first variation of another embodiment.

As shown in FIG. 11, the water valves (50*a*, 50*b*, 50*c*) constituting the water valve mechanism may be omitted from the heat-source-side heat exchanger (40) of the air conditioner (10) of each embodiment. FIG. 11 shows the air conditioner (10) of the first embodiment to which this variation has been applied.

In the heat-source-side heat exchanger (40) of this variation, the heat source water always flow through all the heat source water channels (43*a*, 43*b*, 43*c*) of the heat exchange sections (41*a*, 41*b*, 41*c*). Only to the refrigerant channels (42*b*, 42*c*) of the heat exchange sections (41*b*, 41*c*) at rest, the supply of the refrigerant is stopped.

Second Variation

Figure 12:
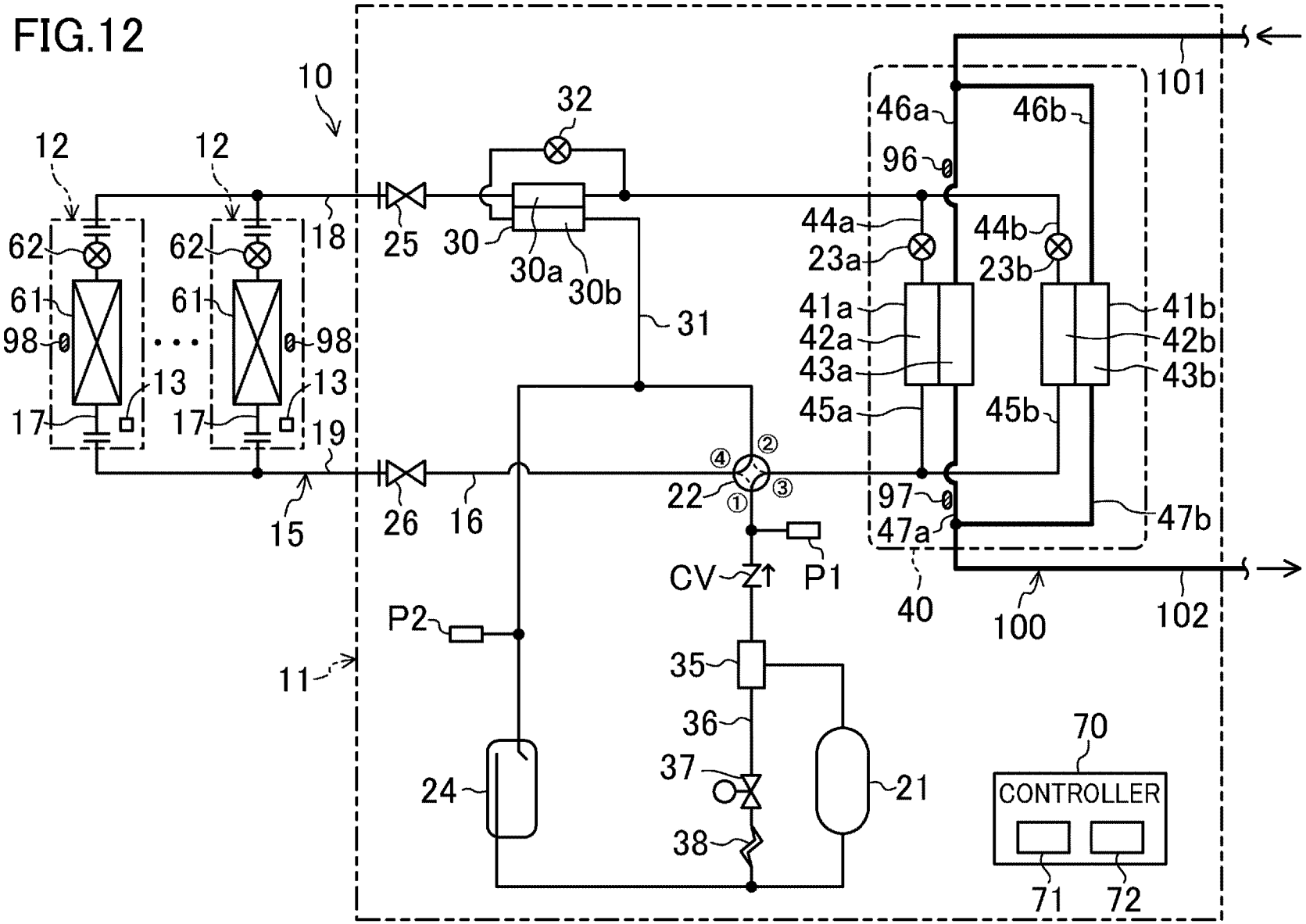
FIG. 12 is a piping diagram illustrating a configuration of an air conditioning system according to a second variation of another embodiment.
Figure 13A:
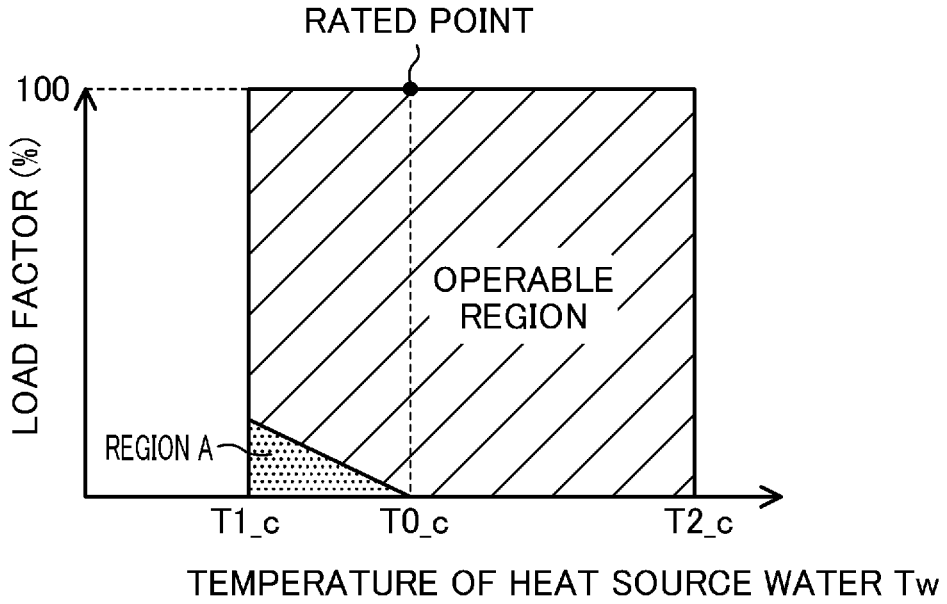
FIG. 13A shows a region where a conventional air conditioner can perform the cooling operation.
Figure 13B:
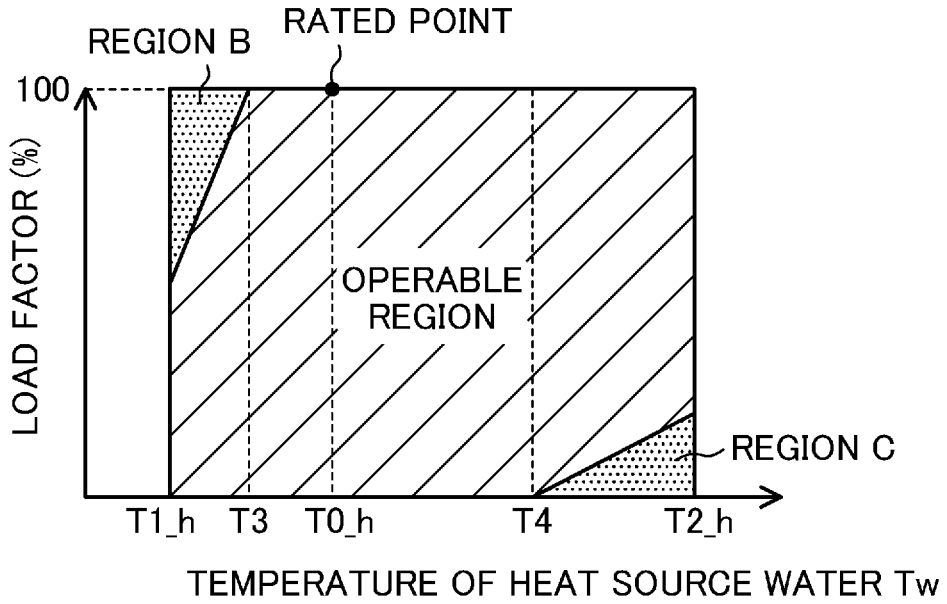
FIG. 13B shows a region where the conventional air conditioner can perform the heating operation.

As shown in FIG. 12, the air conditioner (10) of each embodiment may have, in place of the heat-source-side expansion valve (23), the liquid valves (48, 48*a*, 48*b*), and the gas valves (49, 49*a*, 49*b*), an expansion valve for each of the liquid passages of the heat-source-side heat exchanger (40). FIG. 12 shows the air conditioner (10) of the first variation shown in FIG. 11 to which this variation has been applied. The air conditioner (10) shown in FIG. 12 has no heat-source-side expansion valve (23), liquid valve (48), and gas valve (49), but is provided with an expansion valve (23*a*, 23*b*) for each of the first and second liquid passages (44*a*) and (44*b*) of the heat-source-side heat exchanger (40). Each of the expansion valves (23*a*, 23*b*) of the liquid passages (44*a*, 44*b*) constitutes a refrigerant valve mechanism for changing the number of heat exchange sections (41*a*, 41*b*) into which the refrigerant flows.

Third Variation

In the air conditioner (10) of each embodiment, the heat exchanger control section (84) of the controller (70) may use "an actual measurement of the evaporation temperature of the refrigerant in the indoor unit (12)" in place of the target evaporation temperature Te_t, or "an actual measurement of the condensing temperature of the refrigerant in the indoor unit (12)" in place of the target condensing temperature Tc_t.

As the "actual measurement of the evaporation temperature of the refrigerant in the indoor unit (12)," the "measurement of the utilization-side refrigerant temperature sensor (98)" or the "saturation temperature of the refrigerant corresponding to the measurement LP of the low pressure sensor (92)" may be used. Further, as the "actual measurement of the condensing temperature of the refrigerant in the indoor unit (12)," the "measurement of the utilization-side refrigerant temperature sensor (98)" or the "saturation temperature of the refrigerant corresponding to the measurement HP of the high pressure sensor (91)" may be used.

INDUSTRIAL APPLICABILITY

As can be seen from the foregoing description, the present invention is useful for a heat source unit of a refrigeration apparatus including a heat-source-side heat exchanger in which a refrigerant and heat source water exchange heat.

DESCRIPTION OF REFERENCE CHARACTERS

10 Air Conditioner (Refrigeration Apparatus)
11 Heat Source Unit
12 Indoor Unit (Utilization-side Unit)
15 Refrigerant Circuit
21 Compressor
40 Heat-Source-Side Heat Exchanger
41*a* First Heat Exchange Section

41*b* Second Heat Exchange Section
48 Liquid Valve (Refrigerant Valve Mechanism)
49 Gas Valve (Refrigerant Valve Mechanism)
50 Water Valve (Water Valve Mechanism)
70 Controller (Control Device)
96 Water Temperature Sensor
100 Heat Source Water Circuit

The invention claimed is:

1. A heat source unit forming, together with a utilization-side unit, a refrigeration apparatus including a refrigerant circuit performing a refrigeration cycle, the heat source unit housing at least a compressor and a heat-source-side heat exchanger, each of which is provided for the refrigerant circuit, wherein the heat source unit is configured to perform a cooling action in which the heat-source-side heat exchanger functions as a condenser to cool a target in the utilization-side unit and a heating action in which the heat-source-side heat exchanger functions as an evaporator to heat a target in the utilization-side unit, the heat-source-side heat exchanger is connected to a heat source water circuit in which heat source water circulates so that a refrigerant circulating in the refrigerant circuit exchanges heat with the heat source water, the heat-source-side heat exchanger having a heat exchange region, of a variable size, in which the refrigerant flows and exchanges heat with the heat source water, the heat source unit comprises a controller which adjusts the size of the heat exchange region of the heat-source-side heat exchanger based on a differential temperature index value indicating a difference between a temperature of the refrigerant in the utilization-side unit and a temperature of the heat source water in the heat source water circuit, the heat-source-side heat exchanger includes a first heat exchange section and a second heat exchange section respectively including refrigerant channels connected to the refrigerant circuit and heat source water channels connected to the heat source water circuit, the first heat exchange section is configured to exchange heat between the refrigerant flowing through the refrigerant channel and the heat source water flowing through the heat source water channel, and the second heat exchange section is configured to exchange heat between the refrigerant flowing through the refrigerant channel and the heat source water flowing through the heat source water channel, the refrigerant channel of the first heat exchange section and the refrigerant channel of the second heat exchange section are connected to each other in parallel, the heat source water channel of the first heat exchange section and the heat source water channel of the second heat exchange section are connected to each other in parallel, the heat-source-side heat exchanger includes a liquid valve connected to one end of the refrigerant channel of the second heat exchange section, a gas valve connected to the other end of the refrigerant channel of the second heat exchange section, and a water valve connected to one end of the heat source water channel of the second heat exchange section, and the controller is configured to open the liquid valve, the gas valve, and the water valve to cause the refrigerant and the heat source water to flow through both of the first heat exchange section and the second heat exchange section, open the liquid valve and close the gas valve and the water valve to cause the second heat exchange section to rest in the cooling action, and open the gas valve and close the liquid valve and the water valve to cause the second heat exchange section to rest in the heating action.

2. The heat source unit of claim 1, wherein the controller adjusts the size of the heat exchange region of the heat-source-side heat exchanger so that the differential temperature index value becomes equal to or more than a predetermined reference index value.

3. The heat source unit of claim 2, wherein the controller reduces the size of the heat exchange region of the heat-source-side heat exchanger if the differential temperature index value falls below the reference index value.

4. The heat source unit of claim 2, wherein the controller estimates the differential temperature index value on the assumption that the size of the heat exchange region of the heat-source-side heat exchanger which is smaller than a maximum size has been increased, and increases the size of the heat exchange region of the heat-source-side heat exchanger if the estimated differential temperature index value exceeds the reference index value.

5. The heat source unit of claim 1, wherein the controller determines, during the cooling action, a difference between an entering water temperature and an evaporation temperature or target evaporation temperature of the refrigerant in the utilization-side unit to be the differential temperature index value, the entering water temperature being a temperature of the heat source water supplied to the heat-source-side heat exchanger, and the target evaporation temperature being a target value of the evaporation temperature.

6. The heat source unit of claim 1, wherein the controller determines, during the heating action, a difference between a condensing temperature or target condensing temperature of the refrigerant in the utilization-side unit and an entering water temperature to be the differential temperature index value, the target condensing temperature being a target value of the condensing temperature, and the entering water temperature being a temperature of the heat source water supplied to the heat-source-side heat exchanger.

7. The heat source unit of claim 1, wherein the controller determines, during the cooling action, a difference between an exit water temperature and an evaporation temperature or target evaporation temperature of the refrigerant in the utilization-side unit to be the differential temperature index value, the exit water temperature being a temperature of the heat source water flowing out of the heat-source-side heat exchanger, and the target evaporation temperature being a target value of the evaporation temperature.

8. The heat source unit of claim 1, wherein the controller determines, during the heating action, a difference between a condensing temperature or target condensing temperature of the refrigerant in the utilization-side unit and an exit water temperature to be the differential temperature index value, the target condensing temperature being a target value of the condensing temperature, and the exit water temperature being a temperature of the heat source water flowing out of the heat-source-side heat exchanger.

* * * * *